US011833819B2

(12) United States Patent
Takino

(10) Patent No.: US 11,833,819 B2
(45) Date of Patent: Dec. 5, 2023

(54) LIQUID EJECTING HEAD AND LIQUID EJECTING APPARATUS

(71) Applicant: SEIKO EPSON CORPORATION, Tokyo (JP)

(72) Inventor: Fumiya Takino, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 15 days.

(21) Appl. No.: 17/446,670

(22) Filed: Sep. 1, 2021

(65) Prior Publication Data

US 2022/0063272 A1 Mar. 3, 2022

(30) Foreign Application Priority Data

Sep. 3, 2020 (JP) ..... 2020-148317

(51) Int. Cl.
*B41J 2/14* (2006.01)

(52) U.S. Cl.
CPC .. *B41J 2/14233* (2013.01); *B41J 2002/14362* (2013.01); *B41J 2002/14491* (2013.01)

(58) Field of Classification Search
None
See application file for complete search history.

(56) References Cited

U.S. PATENT DOCUMENTS

2007/0190866 A1* 8/2007 Zart ..... H01R 43/24 439/736
2011/0242190 A1 10/2011 Suzuki et al.
2014/0292908 A1 10/2014 Watanabe et al.
2015/0217570 A1 8/2015 Miyajima
2016/0257118 A1* 9/2016 Kobayashi ..... B41J 2/04541
2019/0100001 A1* 4/2019 Mori ..... B41J 2/14233

FOREIGN PATENT DOCUMENTS

JP 2011-207181 A 10/2011
JP 2014-188887 A 10/2014
JP 2015-145093 A 8/2015
JP 2016-159549 A 9/2016

* cited by examiner

*Primary Examiner* — Erica S Lin
(74) *Attorney, Agent, or Firm* — WORKMAN NYDEGGER

(57) ABSTRACT

A liquid ejecting head includes head chips configured to eject a liquid in a first direction, a holder to which the head chips are fixed, a circuit substrate disposed in an opposite direction to the first direction with respect to the holder, and a cover member disposed in the opposite direction to the first direction with respect to the circuit substrate. The head chips respectively have flexible wiring substrates. Each of the flexible wiring substrates includes a coupling terminal portion coupled to the circuit substrate. The cover member includes first ribs protruding toward the circuit substrate. The first ribs overlap the coupling terminal portions when viewed in the first direction. A first adhesive is disposed between the first ribs and the coupling terminal portions.

20 Claims, 17 Drawing Sheets

LIQUID EJECTING HEAD AND LIQUID EJECTING APPARATUS

The present application is based on, and claims priority from JP Application Serial Number 2020-148317, filed Sep. 3, 2020, the disclosure of which is hereby incorporated by reference herein in its entirety.

BACKGROUND

1. Technical Field

The present disclosure relates to a liquid ejecting head and a liquid ejecting apparatus.

2. Related Art

JP-A-2014-188887 discloses a liquid ejecting head including a lower casing member that accommodates a plurality of head chips, a circuit substrate staked on the lower casing member, and an upper casing member stacked on the lower casing member to cover the circuit substrate. In the liquid ejecting head, piezoelectric actuator parts respectively provided on the head chips are coupled to the circuit substrate via a flexible substrate.

In the liquid ejecting head disclosed in JP-A-2014-188887, a coupling terminal portion of the flexible substrate coupled to the circuit substrate is exposed in the liquid ejecting head. Thus, there is a possibility that moisture in the atmosphere that has entered into the liquid ejecting head adheres to the coupling terminal portion, and causes an electrical problem.

SUMMARY

According to a first aspect of the present disclosure, a liquid ejecting head is provided. The liquid ejecting head includes a plurality of head chips that eject a liquid in a first direction, a holder to which the plurality of head chips are fixed, a circuit substrate disposed in an opposite direction to the first direction with respect to the holder, and a cover member disposed in the opposite direction to the first direction with respect to the circuit substrate. Each of the plurality of head chips includes a flexible wiring substrate. The flexible wiring substrate includes a coupling terminal portion coupled to the circuit substrate. The circuit substrate has a first surface mounted on the holder and a second surface that opposes the first surface and is coupled to the coupling terminal portion. The cover member includes a plurality of first ribs protruding toward the second surface of the circuit substrate. The plurality of first ribs are disposed at positions respectively overlapping the coupling terminal portions of the plurality of head chips when viewed in the first direction. A first adhesive is disposed between the plurality of first ribs and the coupling terminal portions of the plurality of head chips.

According to a second aspect of the present disclosure, a liquid ejecting apparatus is provided. The liquid ejecting apparatus includes the above-described liquid ejecting head in the first aspect, and a cap. The liquid ejecting head includes an ejecting surface on which the liquid is ejected. The cap seals the ejecting surface by relatively moving to the ejecting surface in the opposite direction to the first direction and contacting on the ejecting surface.

DESCRIPTION OF EXEMPLARY EMBODIMENTS

A. First Embodiment

Figure 1:
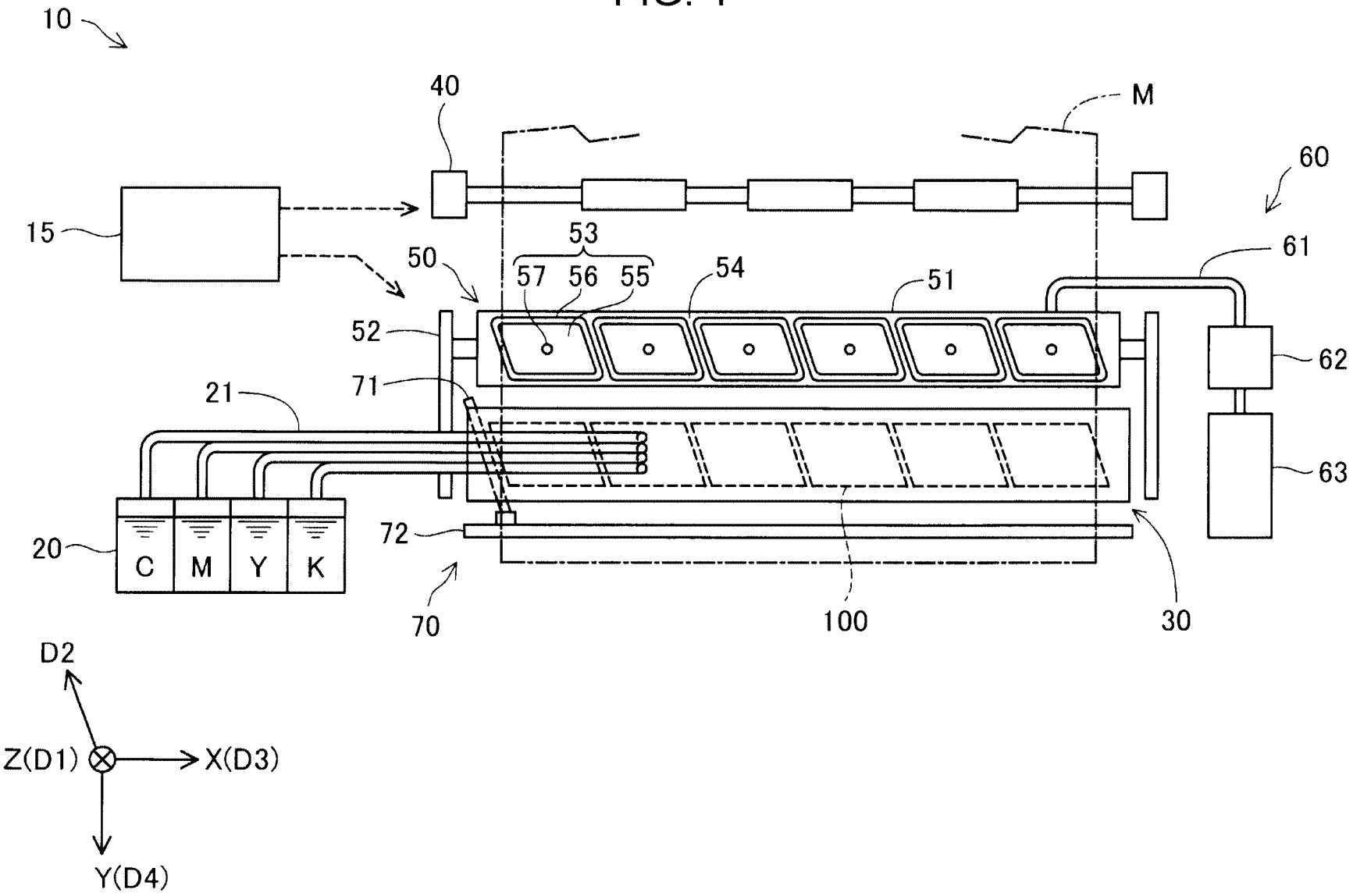
FIG. 1 is a schematic diagram illustrating a configuration of a liquid ejecting apparatus according to a first embodiment.

FIG. 1 is a schematic diagram illustrating a configuration of a liquid ejecting apparatus 10 according to a first embodiment. In FIG. 1, arrows indicating X, Y, and Z directions perpendicular to each other are illustrated. The X and Y directions are parallel to the horizontal plane, and the Z direction is the direction of gravity. The arrows indicating the X, Y, and Z directions are appropriately illustrated in other drawings so that the directions of the arrows correspond to those in FIG. 1. In the following description, when specifying the direction, the positive direction being a direction indicated by the arrow is defined as "+", and the negative direction being a direction opposite to the direction indicated by the arrow is defined as "−". Both positive and negative signs are used in the direction notation. The +Z direction may be referred to as a "first direction D1". The +X direction may be referred to as a "third direction D3". The +Y direction may be referred to as a "fourth direction D4".

In the present embodiment, the liquid ejecting apparatus 10 is configured as an ink jet printer that performing printing of an image on a medium M by ejecting an ink as a liquid. The liquid ejecting apparatus 10 includes a controller 15, a liquid container 20, a head unit 30, a transport mechanism 40, a capping mechanism 50, a suction mechanism 60, and a wiping mechanism 70.

The controller 15 is configured by a computer including one or a plurality of processors, a main storage device, and an input/output interface for inputting and outputting a signal to and from the outside of the apparatus. The controller 15 performs various functions by the processor executing a program or a command read on the main storage device. For example, the controller 15 receives image data from a computer coupled by a wired communication or a wireless communication, and converts the received image data into print data indicating on and off of dots to be formed on a medium M. The controller 15 ejects an ink from the head unit 30 while the transport mechanism 40 transports the medium M in the +Y direction, in accordance with the print data, to form dots with the ink at predetermined positions on the medium M. In this manner, the liquid ejecting apparatus 10 performs printing of an image on the medium M.

The liquid container 20 stores the ink to be ejected onto the medium M. In the present embodiment, the liquid container 20 is configured by four containers. The containers individually store four color inks of cyan, magenta, yellow, and black, respectively. Each container of the liquid container 20 is coupled to the head unit 30 via a supply path 21. The supply path 21 is configured by, for example, a flexible tube. The ink stored in the liquid container 20 is supplied to the head unit 30 by, for example, a water head difference. A pressure pump for pressure-feeding the ink toward the head unit 30 may be provided between the liquid container 20 and the head unit 30.

The head unit 30 includes six liquid ejecting heads 100 arranged in the X direction. The head unit 30 distributes the ink of each color, which is supplied from the liquid container 20 via the supply path 21, to each liquid ejecting head 100. The head unit ejects the ink from each liquid ejecting head 100 onto the medium M under a control of the controller 15. The number of liquid ejecting heads 100 provided in the head unit 30 is not limited to six, and may be one, two to five, or seven or more.

The transport mechanism 40 transports the medium M under the control of the controller 15. In the present embodiment, the transport mechanism 40 transports the medium M in the +Y direction. The transport mechanism 40 is, for example, a roller transport type in which the medium M is interposed between rollers from both sides, and then the medium M is transported by a motor rotating the rollers. In addition to the roller transport type, the transport mechanism 40 may be a belt transport type or a drum transport type. In the belt transport type, the medium M is attracted to a belt by using static electricity or air pressure, and then the medium M is transported by the belt. In the drum transport type, the medium M is fed out by rotating a drum around which the medium M is wound.

The capping mechanism 50 includes a cap unit 51 and a cap moving portion 52. In the present embodiment, the cap unit 51 is configured by six caps 53 arranged in the X direction and a support member 54 that supports the six caps 53. Each of the caps 53 has a base 55 and a rib 56 protruding from the base 55 in the −Z direction. The rib 56 is formed in an annular shape when viewed in the +Z direction. A through-hole 57 is provided on an inner side of the rib 56 in the base 55. The cap moving portion 52 relatively moves the cap unit 51 with respect to the head unit 30 under the control of the controller 15. The cap moving portion 52 is configured by, for example, a guide rail and a motor. The cap moving portion 52 relatively moves the cap unit 51 with respect to the head unit 30 in the −Z direction during a period in which the ink is not ejected from each liquid ejecting head 100 onto the medium M. Thus, a tip portion of each rib 56 is caused to contact on the ejecting surface of each liquid ejecting head 100, and at least a portion of the ejecting surface of each liquid ejecting head 100 is covered by the cap 53. The ejecting surface means a surface on which the ink is ejected among the surfaces of the liquid ejecting head 100. In the present embodiment, the ejecting surface is a surface on the +Z direction side among the surfaces of the liquid ejecting head 100. The ejecting surface is configured by a nozzle plate 210 and a fixing plate 150, which will be described later. An operation of covering at least a portion of the ejecting surface of each liquid ejecting head 100 by the cap 53 is referred to as capping. The cap moving portion 52 may not move the cap unit 51 but move the head unit 30 to cover at least a portion of the ejecting surface of each liquid ejecting head 100 by the cap 53.

The suction mechanism 60 includes a discharge path 61, a suction pump 62, and a waste liquid tank 63. The discharge path 61 communicates with each through-hole 57 provided in the cap 53. The discharge path 61 is configured by, for example, a flexible tube. The suction pump 62 is driven under the control of the controller 15. In capping, the suction pump generates negative pressure in a space surrounded by each liquid ejecting head 100 and the cap 53 to suck air bubbles and foreign substances from each liquid ejecting head 100 together with the ink. The suction pump 62 is configured by, for example, a tube pump. The waste liquid tank 63 stores the ink discharged from each liquid ejecting head 100 by the suction pump 62. An operation of, in capping, generating negative pressure in the space surrounded by each liquid ejecting head 100 and the cap 53 to suck air bubbles and foreign substances from each liquid ejecting head 100 together with the ink is referred to as suction cleaning.

The wiping mechanism 70 includes a wiping member 71 and a wiping member moving portion 72. The wiping member 71 is configured by, for example, a rubber blade. The wiping member 71 may be made of cloth or the like. The wiping member moving portion 72 is configured by, for example, a guide rail and a motor. The wiping member moving portion 72 relatively moves the wiping member 71 with respect to the head unit 30 in the +X direction under the control of the controller 15, and thereby the wiping member 71 wipes off the ink, the foreign substances, and the like adhering to the head unit 30. An operation in which the wiping member 71 wipes off the ink, the foreign substances, and the like adhering to the head unit 30 is referred to as wiping. The wiping member moving portion 72 may relatively move the wiping member 71 with respect to the head unit 30 in the −X direction, and thereby the wiping member 71 may wipe off the ink, the foreign substances, and the like adhering to the head unit 30.

Figure 2:
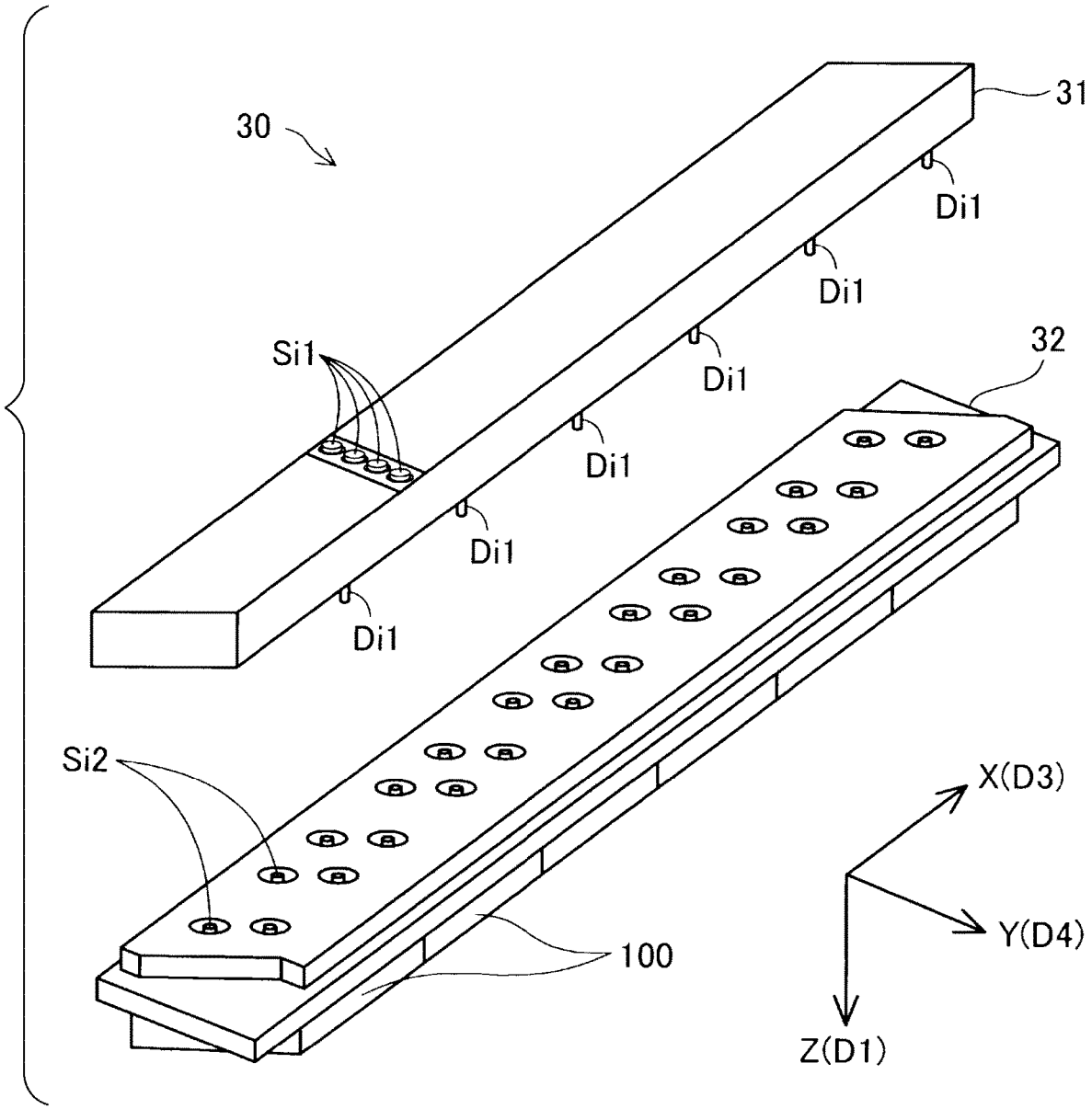
FIG. 2 is a first exploded perspective view schematically illustrating a configuration of a head unit in the first embodiment.
Figure 3:
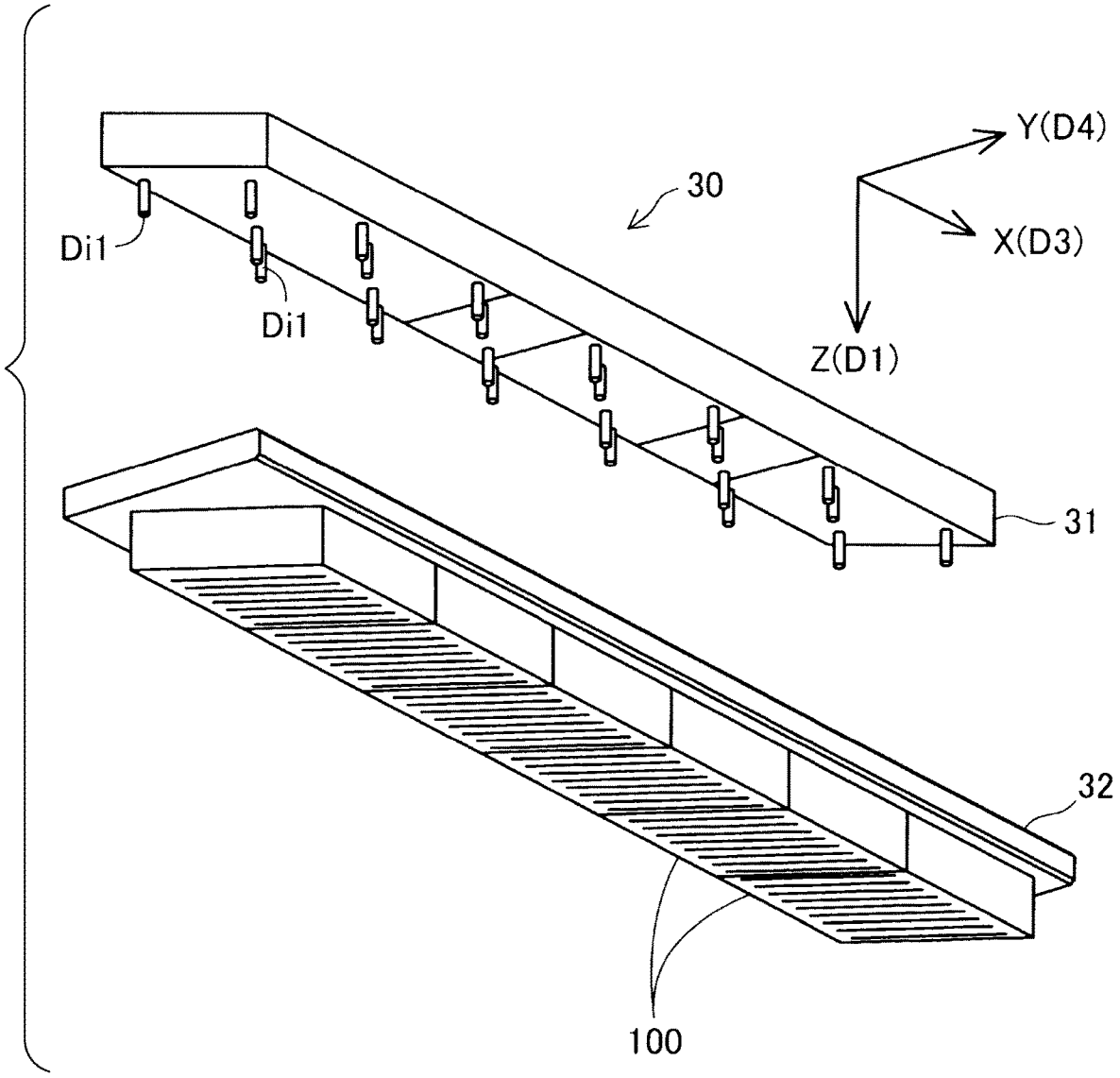
FIG. 3 is a second exploded perspective view schematically illustrating the configuration of the head unit in the first embodiment.
Figure 4:
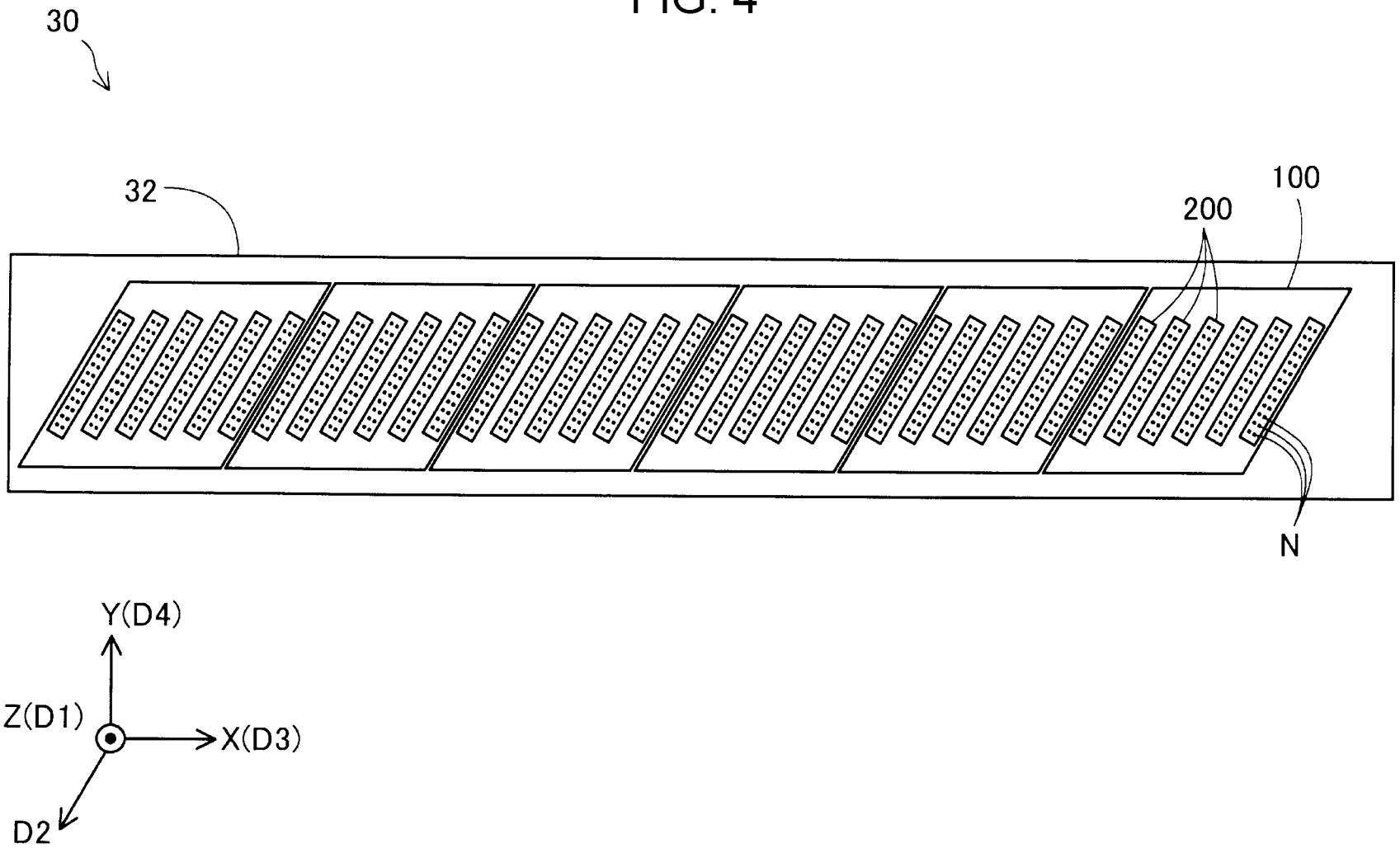
FIG. 4 is a bottom view schematically illustrating the configuration of the head unit in the first embodiment.
Figure 5:
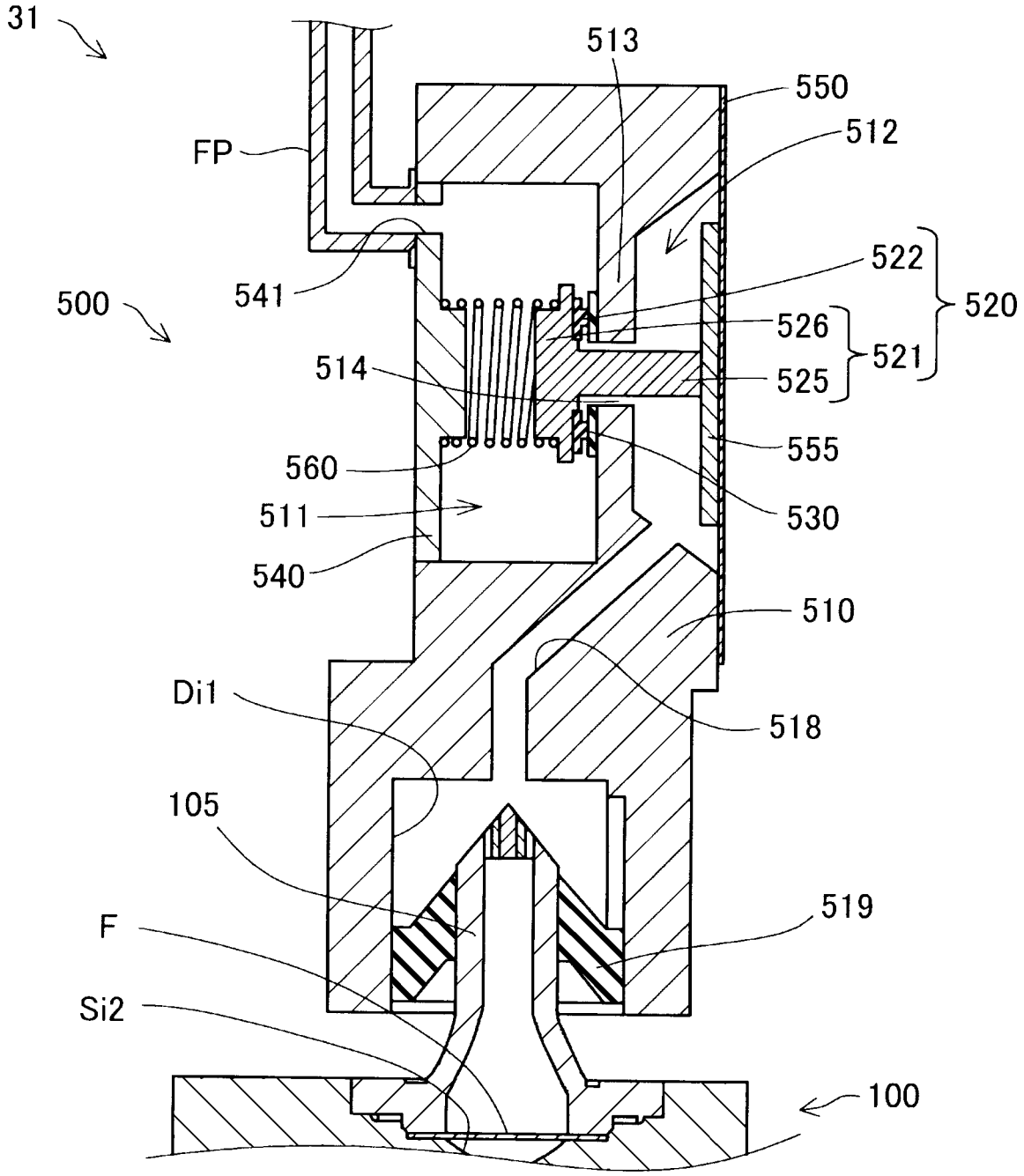
FIG. 5 is a cross-sectional view illustrating a configuration of a first liquid outflow port in the first embodiment.

FIG. 2 is a first exploded perspective view schematically illustrating a configuration of the head unit 30. FIG. 3 is a second exploded perspective view schematically illustrating the configuration of the head unit 30. FIG. 4 is a bottom view schematically illustrating the configuration of the head unit 30. FIG. 5 is a cross-sectional view illustrating a configuration of a first liquid outflow port Di1 of the head unit 30. As illustrated in FIGS. 2 and 3, the head unit 30 includes a distribution flowpath member 31, a support member 32, and six liquid ejecting heads 100.

The distribution flowpath member 31 is provided with first liquid inflow ports Si1 and the first liquid outflow ports Di1. The number of first liquid inflow ports Si1 corresponds to the number of ink colors. The number of first liquid outflow ports Di1 corresponds to the number of ink colors and the number of liquid ejecting heads 100. In the present embodiment, as illustrated in FIG. 2, four first liquid inflow ports Si1 are provided on the surface of the distribution flowpath member 31 on the −Z direction side. The supply path 21 is coupled to each of the first liquid inflow ports Si1. As illustrated in FIG. 3, 24 first liquid outflow ports Di1 are provided on the surface of the distribution flowpath member 31 on the +Z direction side.

Four ink flow paths are provided in the distribution flowpath member 31. One ink flow path is configured by a common flow path communicating with one first liquid inflow port Si1 and six individual flow paths divided from the common flow path. The common flow path and one first liquid outflow port Di1 communicate with each other by one individual flow path. The ink introduced into the distribution flowpath member 31 from one first liquid inflow port Si1 is distributed into the six first liquid outflow ports Di1 via the common flow path and the individual flow paths. A pressure adjusting valve 500 illustrated in FIG. 5 is provided between each individual flow path and the first liquid outflow port Di1. The pressure of the ink distributed into each first liquid outflow port Di1 is adjusted by the pressure adjusting valve 500. The configuration of the pressure adjusting valve 500 will be described later.

As illustrated in FIG. 2, the support member 32 is disposed on the +Z direction side of the distribution flowpath member 31, and is fixed to the distribution flowpath member 31 by a screw, an adhesive, or the like. Each liquid ejecting head 100 is disposed on the +Z direction side of the support member 32. Each liquid ejecting head 100 is fixed to the support member 32 by a screw, an adhesive, or the like. Each liquid ejecting head 100 includes four second liquid inflow ports Si2. An opening portion for exposing the second liquid inflow port Si2 is provided in the surface of the support member 32 on the −Z direction side. Each second liquid inflow port Si2 is coupled to each first liquid outflow port Di1. The distribution flowpath member 31 and the support member 32 may be integrated and made of the same member.

As illustrated in FIG. 4, each liquid ejecting head 100 includes a plurality of nozzle rows arranged in the X direction. Each nozzle row is configured by a plurality of nozzles N arranged in a second direction D2 which is perpendicular to the Z direction and intersects both the X direction and the Y direction. Each liquid ejecting head 100 ejects the ink from the nozzles N. The plurality of nozzles N are divided into a group for ejecting a cyan ink, a group for ejecting a magenta ink, a group for ejecting a yellow ink, and a group for ejecting a black ink.

As illustrated in FIG. 5, the pressure adjusting valve 500 includes a housing 510, a valve body 520, a valve seat 530, a lid member 540, a film member 550, and a spring 560. A primary room 511 and a secondary room 512 are provided in the housing 510. The primary room 511 and the secondary room 512 are separated by a partition wall 513. The partition wall 513 is provided with a communication path 514 for causing the primary room 511 and the secondary room 512 to communicate with each other.

The primary room 511 is formed by sealing an opening portion of a recess provided in the housing 510 with the lid member 540. The secondary room 512 is formed by sealing an opening portion of a recess provided in the housing 510 with the flexible film member 550. As the material of the film member 550, for example, high-density polyethylene, polyethylene terephthalate, or the like may be used. A pressure receiving plate 555 is adhered to the surface of the film member 550 on the secondary room 512 side. The rigidity of the pressure receiving plate 555 is higher than the rigidity of the film member 550. A space on an opposite side of the secondary room 512 with the film member 550 interposed between the space and the secondary room communicates with the atmosphere.

The primary room 511 communicates with an individual flow path FP via an inflow path 541 provided in the lid member 540. The individual flow path FP communicates with the first liquid inflow port Si1. The secondary room 512 communicates with the first liquid outflow port Di1 via an outflow path 518 provided in the housing 510. A seal member 519 is provided at the first liquid outflow port Di1. A supply needle 105 for introducing the ink into the liquid ejecting head 100 is provided at a tip portion of the second liquid inflow port Si2 of the liquid ejecting head 100. In the supply needle 105, an ink flow path and a filter F for collecting air bubbles and foreign substances contained in the ink are provided. The supply needle 105 penetrates the seal member 519 so that the ink flow path in the supply needle 105 communicates with the outflow path 518.

The valve body 520 is disposed to be movable in the housing 510. The valve body 520 includes a valve main body 521 and an contacting member 522. The valve main body 521 has a columnar shaft portion 525 and a disk-like flange portion 526 coupled to one end of the shaft portion 525. The shaft portion 525 is inserted through the communication path 514. A gap through which the ink flows is formed between the shaft portion 525 and the communication path 514. A tip portion of the shaft portion 525 on the opposite side of the flange portion 526 contacts on the pressure receiving plate 555. The flange portion 526 is disposed in the primary room 511. The contacting member 522 is fixed to the surface of the flange portion 526 on the partition wall 513 side. The contacting member 522 is provided in an annular shape to surround the shaft portion 525. The contacting member 522 is formed of rubber or an elastomer. The valve seat 530 is fixed to the partition wall 513 to face the contacting member 522. The valve seat 530 is provided in an annular shape to surround the communication path 514.

The spring 560 is disposed between the flange portion 526 of the valve body 520 and the lid member 540. One end of the spring 560 contacts on the flange portion 526. The other end of the spring 560 contacts on the lid member 540. The spring 560 urges the valve body 520 toward the secondary room 512. The contacting member 522 of the valve body 520 contacts on the valve seat 530 by the urging force of the spring 560, and thus the communication path 514 is blocked, in other words, the pressure adjusting valve 500 is closed.

When the ink stored in the secondary room 512 flows out from the outflow path 518 and thus the pressure in the secondary room 512 decreases, the film member 550 is bent by the pressure difference between the pressure in the secondary room 512 and the atmospheric pressure. Thus, the pressure receiving plate 555 adhered to the film member 550 moves to the primary room 511 side. When the pressure receiving plate 555 presses the shaft portion 525 against the urging force of the spring 560, the valve body 520 moves, and a gap is formed between the contacting member 522 and the valve seat 530. Thus, the communication path 514 is opened, in other words, the pressure adjusting valve 500 is opened.

When the ink flows from the primary room 511 into the secondary room 512 by the opening of the pressure adjusting valve 500, the pressure difference between the pressure in the secondary room 512 and the atmospheric pressure decreases. Thus, the valve body 520 and the pressure receiving plate 555 are brought back to the original positions by the urging force of the spring 560. The gap between the contacting member 522 and the valve seat 530 is removed, and thus the communication path 514 is blocked, in other words, the pressure adjusting valve 500 is closed. In this manner, the pressure adjusting valve 500 is capable of adjusting the pressure of the ink supplied from the distribution flowpath member 31 to the liquid ejecting head 100. Thus, it is possible to stabilize the supply of the ink from the distribution flowpath member 31 to each liquid ejecting head 100.

Figure 6:
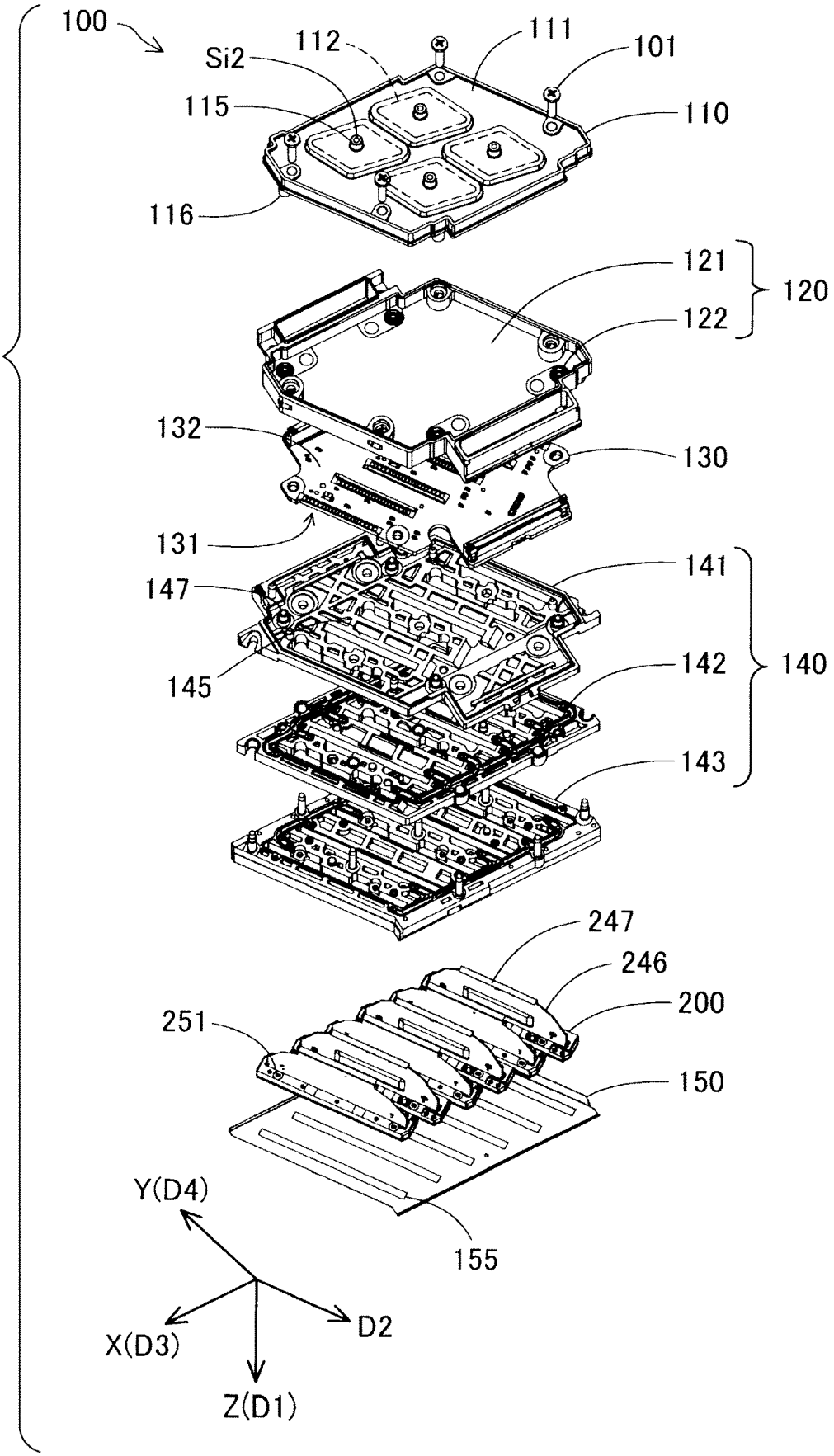
FIG. 6 is an exploded perspective view illustrating a configuration of a liquid ejecting head in the first embodiment.
Figure 7:
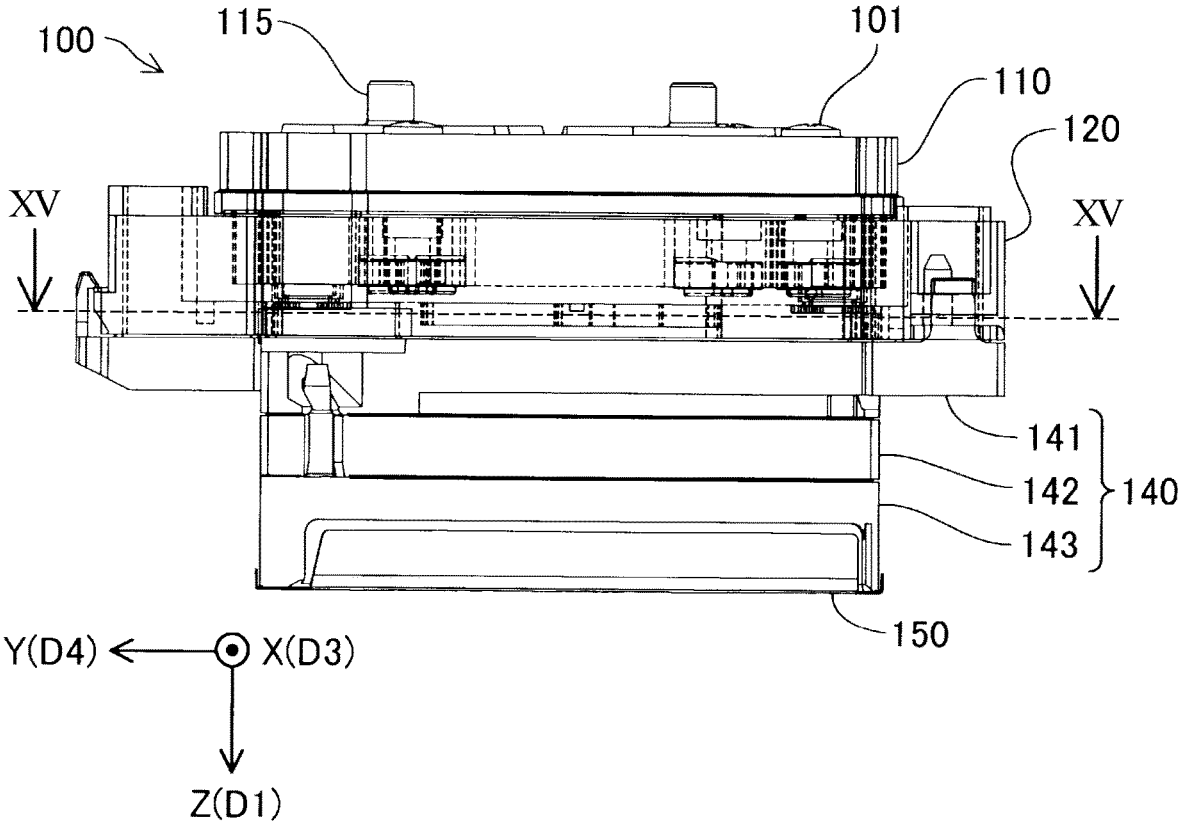
FIG. 7 is a side view illustrating the configuration of the liquid ejecting head in the first embodiment.
Figure 8:
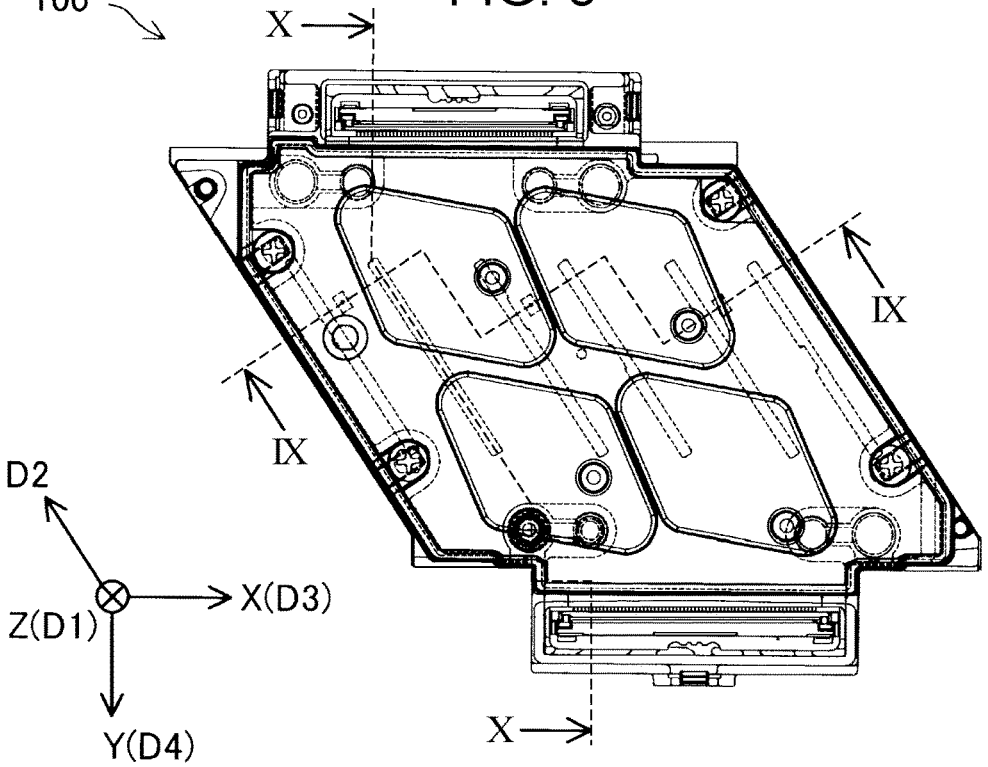
FIG. 8 is a plan view illustrating the configuration of the liquid ejecting head in the first embodiment.
Figure 9:
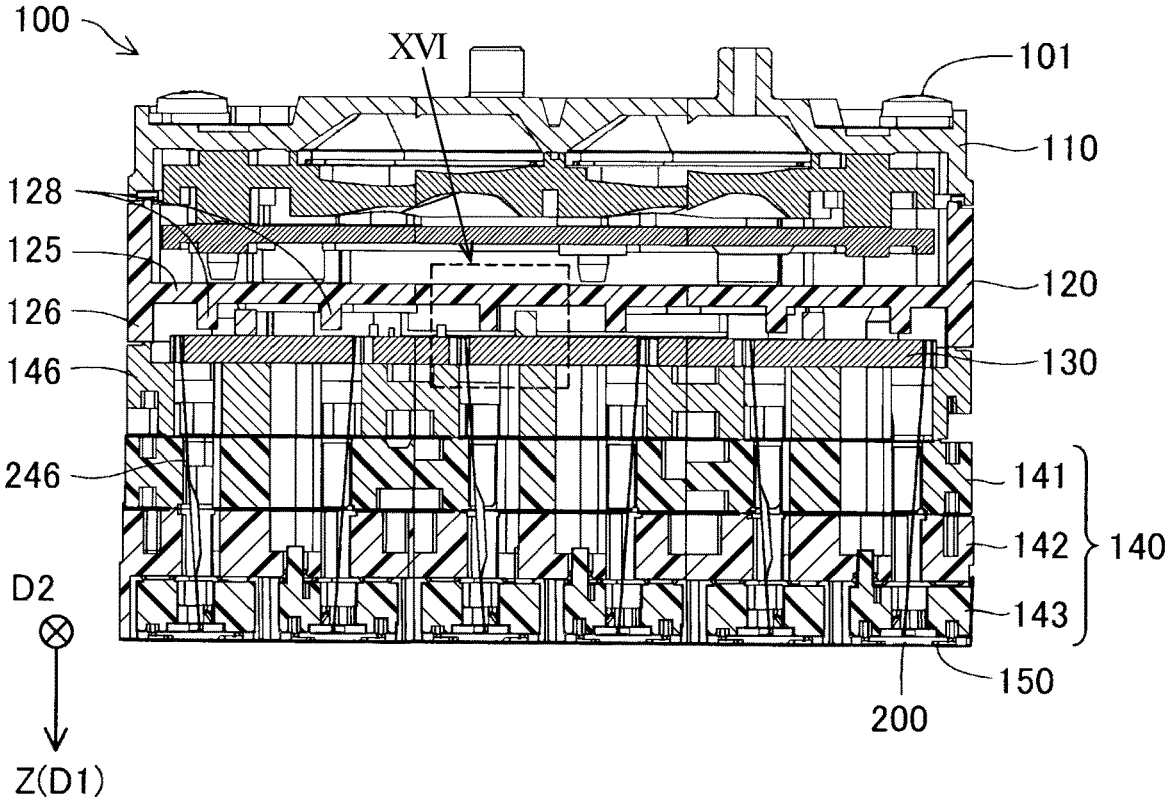
FIG. 9 is a cross-sectional view taken along line IX-IX in FIG. 8.
Figure 10:
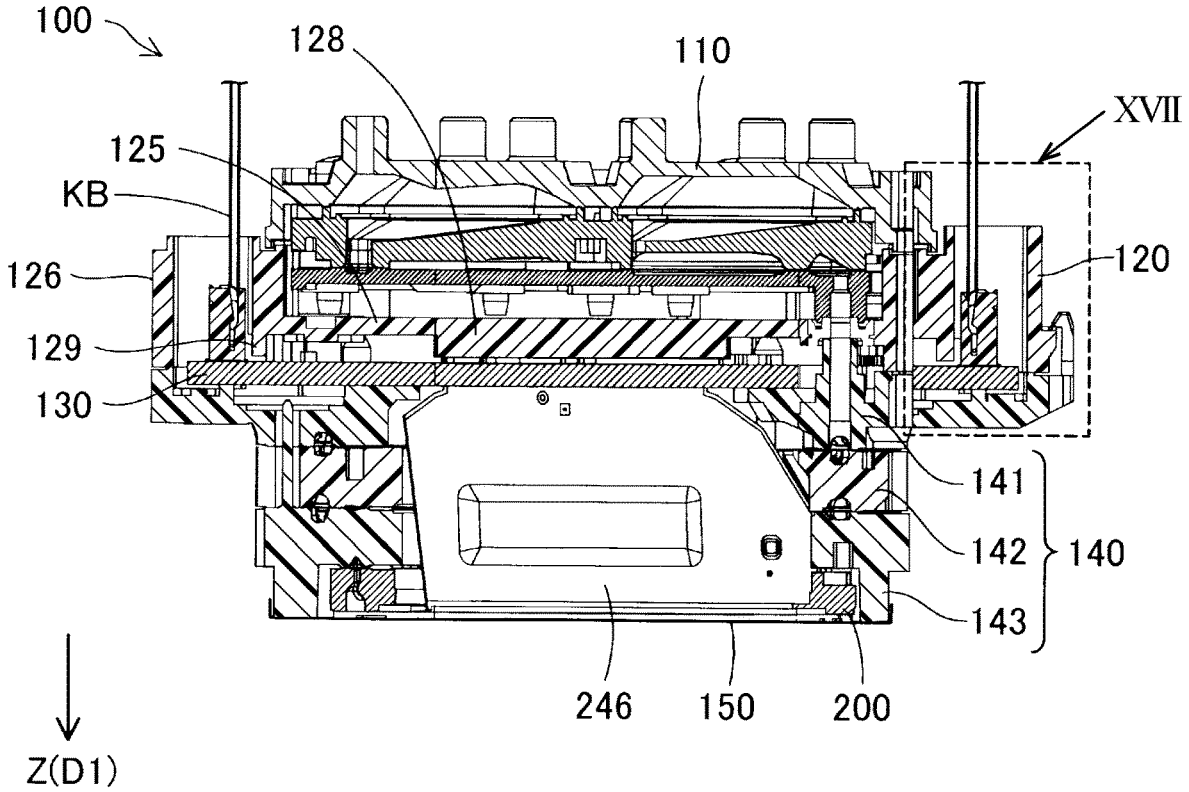
FIG. 10 is a cross-sectional view taken along line X-X in FIG. 8.

FIG. 6 is an exploded perspective view illustrating the configuration of the liquid ejecting head 100. FIG. 7 is a side view illustrating the configuration of the liquid ejecting head 100. FIG. 8 is a plan view illustrating the configuration of the liquid ejecting head 100. FIG. 9 is a cross-sectional view taken along line IX-IX in FIG. 8. FIG. 10 is a cross-sectional view taken along line X-X in FIG. 8. As illustrated in FIG. 6, the liquid ejecting head 100 includes six head chips 200, a filter unit 110, a cover member 120, a circuit substrate 130, a holder 140, and the fixing plate 150.

As illustrated in FIG. 6, the fixing plate 150, the holder 140, the circuit substrate 130, the cover member 120, and the filter unit 110 are disposed to be stacked in this order from the +Z direction side. As illustrated in FIG. 9, the six head chips 200 are accommodated in a space surrounded by the fixing plate 150 and the holder 140. The number of head chips 200 provided in one liquid ejecting head 100 may be two or more, and is not limited to six.

As illustrated in FIG. 6, the filter unit 110 includes a flowpath member 111 and a filter 112. The flowpath member 111 is formed in a plate shape. The flowpath member 111 includes four upper flowpath pipes 115 and four lower flowpath pipes 116. Each of the upper flowpath pipes 115 protrudes from the upper surface of the flowpath member 111 in the −Z direction. The second liquid inflow port Si2 described above is provided at the tip portion of each of the upper flowpath pipes 115. Although not illustrated in FIG. 6, the supply needle 105 illustrated in FIG. 5 is fixed to the second liquid inflow port Si2. Each of the lower flowpath pipes 116 protrudes from the bottom surface of the flowpath member 111 in the +Z direction.

Each of the upper flowpath pipes 115 and the lower flowpath pipes 116 is formed in a tubular shape, and has an ink flow path therein. Four ink flow paths are provided in the flowpath member 111. Each of the ink flow paths communicates one upper flowpath pipe 115 and one lower flowpath pipe 116. The filter 112 is disposed in each of the flow paths in the flowpath member 111. The filter 112 collects foreign substances contained in the ink. The flow path provided in the upper flowpath pipe 115, the flow path provided in the lower flowpath pipe 116, and the flow path provided in the flowpath member 111 may be referred to as a "first flowpath portion". The lower flowpath pipe 116 may be referred to as a "first flowpath pipe".

In the present embodiment, the flowpath member 111 is formed of a resin material such as Zylon (registered trademark) or a liquid crystal polymer. The filter unit 110 is fixed to the cover member 120 by screws 101. The screw 101 is inserted through the filter unit 110 and the cover member 120 in the Z direction. The filter unit 110 may be fixed to the cover member 120 not by the screw 101, but by an adhesive.

The cover member 120 includes a main body portion 121 and four elastic seal portions 122. Each of the elastic seal portions 122 is formed in a cylindrical shape centered on a central axis along the Z direction. Into each of the elastic seal portions 122, the tip portion of the lower flowpath pipe 116 of the filter unit 110 is inserted from the −Z direction side, and the tip portion of an upper flowpath pipe 147 of the holder 140 described later is inserted from the +Z direction side. Each of the elastic seal portions 122 suppresses ink leakage from between the lower flowpath pipe 116 and the upper flowpath pipe 147.

In the present embodiment, the cover member 120 is configured in which the main body portion 121 formed of a resin material such as Zylon (registered trademark) or a liquid crystal polymer that is relatively hard to be deformed and the elastic seal portions 122 formed of an elastomer such as nitrile rubber, silicone rubber, or fluororubber are integrated by two-color molding. The main body portion 121 is fixed to the holder 140 by an adhesive. The main body portion 121 may be formed of a metal material such as stainless steel. In this case, the metal material forming the main body portion 121 and the elastomer forming the elastic seal portion 122 may be integrated by insert molding or outsert molding. The main body portion 121 and the elastic seal portion 122 may not be integrated. A more specific configuration of the cover member 120 will be described later.

The circuit substrate 130 supplies a drive signal and a power source voltage to each of the head chips 200. The circuit substrate 130 is formed in a plate shape. The circuit substrate 130 has a first surface 131 being a surface on the +Z direction side and a second surface 132 being a surface on an opposite side of the first surface 131. A notch portion is provided at the corner of the circuit substrate 130 so as not to interfere with the upper flowpath pipe 147 of the holder 140. In the present embodiment, the circuit substrate 130 is fixed to the cover member 120 and the holder 140 by an adhesive. A more specific configuration of the circuit substrate 130 will be described later.

The holder 140 is configured by a first holder member 141, a second holder member 142, and a third holder member 143. The third holder member 143, the second holder member 142, and the first holder member 141 are disposed to be stacked in this order from the +Z direction side.

The first holder member 141 includes four upper flowpath pipes 147. Each of the upper flowpath pipes 147 protrudes from an upper surface portion 145 of the first holder member 141 in the −Z direction. Each of the upper flowpath pipes 147 is formed in a tubular shape, and has an ink flow path therein. A tip portion of each of the upper flowpath pipes 147 is inserted into the elastic seal portion 122 of the cover member 120.

An ink flow path for distributing the ink introduced from each of the upper flowpath pipe 147 into the six head chips 200 is provided in each of the holder members 141 to 143. In the present embodiment, the holder members 141 to 143 are formed of a resin material such as Zylon (registered trademark) or a liquid crystal polymer. The holder members 141 to 143 are fixed to each other by an adhesive. The first holder member 141 is fixed to the main body portion 121 of the cover member 120 and the circuit substrate 130 by an adhesive. The third holder member 143 is fixed to the fixing plate 150 by an adhesive.

The fixing plate 150 includes opening portions 155 of which the number corresponds to the number of head chips 200. In the present embodiment, the fixing plate 150 includes six opening portions 155 arranged in the X direction. Each of the opening portions 155 is provided to penetrate the fixing plate 150, and exposes a nozzle row provided in the nozzle plate 210 of each head chip 200. The fixing plate 150 is made of a metal material such as stainless steel.

The head chips 200 are arranged in the X direction on the opening portions 155 of the fixing plate 150, respectively. Each of the head chips 200 is fixed to the surface of the fixing plate 150 on the −Z direction side by an adhesive. Four liquid introduction ports 251 for introducing the ink are provided in each of the head chips 200. The ink distributed by the flow path provided in each of the holder members 141 to 143 is supplied to each of the liquid introduction ports 251. Each of the head chips 200 includes a flexible wiring substrate 246. A coupling terminal portion 247 coupled to the circuit substrate 130 is provided at one end of the flexible wiring substrate 246.

Figure 11:
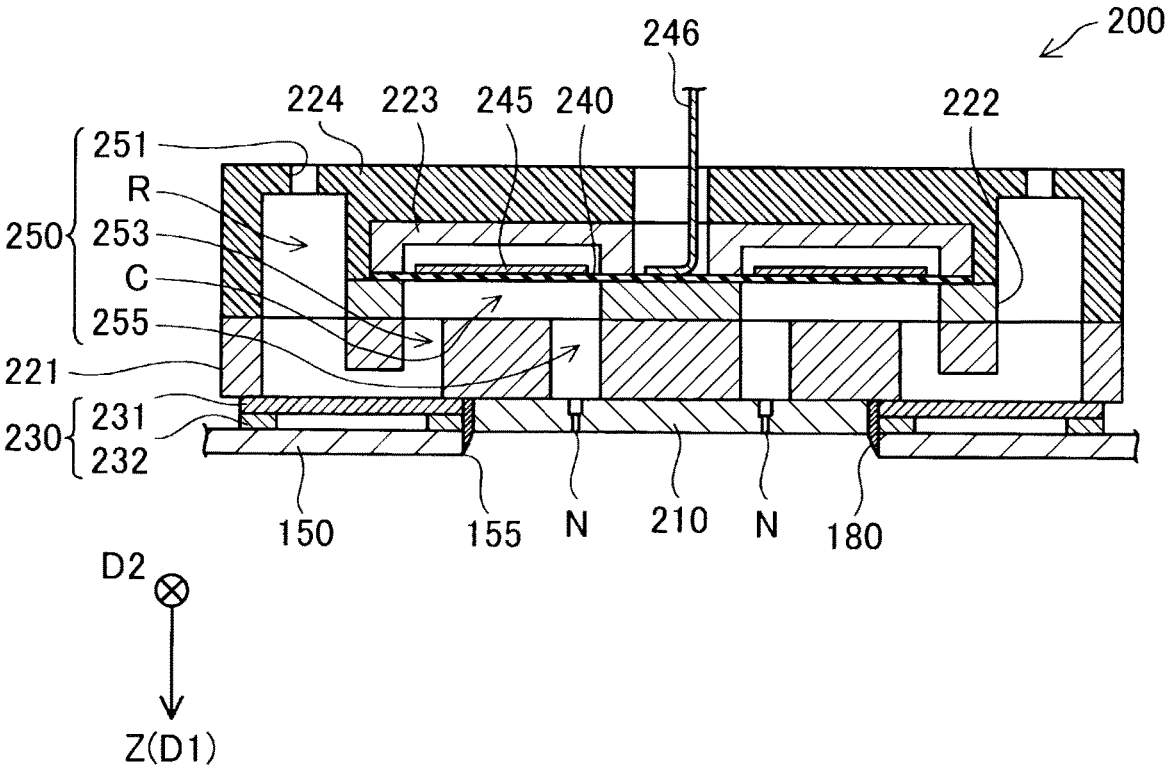
FIG. 11 is a cross-sectional view schematically illustrating a configuration of a head chip in the first embodiment.

FIG. 11 is a cross-sectional view schematically illustrating the configuration of the head chip 200. FIG. 11 illustrates a cross section of one head chip 200 and the fixing plate 150. The head chip 200 includes the nozzle plate 210, a flowpath forming substrate 221, a pressure chamber substrate 222, a protective substrate 223, a compliance portion 230, a vibrating plate 240, a piezoelectric element 245, a flexible wiring substrate 246, and a case 224. In the nozzle plate 210, a plurality of nozzles N for ejecting the ink are provided.

The head chip 200 includes the liquid introduction port 251 for introducing the ink, a reservoir room R, an individual flow path 253, a pressure chamber C, and a communication flow path 255, as an ink flow path 250 that communicates with the nozzles N. The ink flow path 250 is configured by stacking the flowpath forming substrate 221, the pressure chamber substrate 222, and the case 224. The communication flow path 255, the individual flow path 253, and the lower portion of the reservoir room R are provided on the flowpath forming substrate 221. The pressure chamber C is provided on the pressure chamber substrate 222. The liquid introduction port 251 and the upper portion of the reservoir room R are provided in the case 224.

The ink introduced into the case 224 from the liquid introduction port 251 is stored in the reservoir room R. The reservoir room R is a common flow path that communicates with a plurality of individual flow paths 253 respectively corresponding to the plurality of nozzles N constituting the nozzle row. The ink stored in the reservoir room R is supplied to the pressure chamber C through the individual flow path 253. The ink pressurized in the pressure chamber C is ejected from the nozzle N in the +Z direction through the communication flow path 255. The individual flow path 253, the pressure chamber C, and the communication flow path 255 are provided for each nozzle N in the head chip 200.

The nozzle plate 210, the flowpath forming substrate 221, and the pressure chamber substrate 222 are formed of single crystal silicon. The case 224 is formed of a resin material such as Zylon (registered trademark) or a liquid crystal polymer, for example. The nozzle plate 210, the flowpath forming substrate 221, the pressure chamber substrate 222, and the case 224 are fixed to each other by an adhesive.

The nozzle plate 210 and the compliance portion 230 are fixed to the bottom surface of the flowpath forming substrate 221. The nozzle plate 210 is fixed to the lower side of the communication flow path 255. The compliance portion 230 is fixed to the lower side of the reservoir room R and the individual flow path 253. The compliance portion 230 is configured by a sealing film 231 and a support 232. The sealing film 231 is a flexible film-like member. The lower side of the reservoir room R and the individual flow path 253 is sealed by the sealing film 231. The outer peripheral edge of the sealing film 231 is supported by the frame-shaped support 232. The bottom surface of the support 232 is fixed to the fixing plate 150. The compliance portion 230 suppresses pressure fluctuation of the ink in the reservoir room R and the individual flow path 253.

The upper side of the pressure chamber C is sealed by the vibrating plate 240. In the present embodiment, the vibrating plate 240 is configured by stacking an elastic film-like member of silicon oxide or the like and an insulating film-like member of zirconium oxide or the like. The elastic film-like member of silicon oxide or the like in the vibrating plate 240 described above and the pressure chamber substrate 222 may be integrated and formed with the same member.

The piezoelectric element 245 as a driving device is provided on the upper surface of the vibrating plate 240. The piezoelectric element 245 is configured by a piezoelectric body and electrodes formed on both sides of the piezoelectric body. Each of the electrodes of the piezoelectric element 245 is electrically coupled to the flexible wiring substrate 246 provided in the case 224. The flexible wiring substrate 246 is electrically coupled to the circuit substrate 130. The piezoelectric element 245 receives a drive signal supplied from the controller 15 through the flexible wiring substrate 246 to vibrate together with the vibrating plate 240 and change the volume of the pressure chamber C. By reducing the volume of the pressure chamber C, the ink in the pressure chamber C is pressurized, and the ink is ejected from the nozzle N. A heating body may be used as the driving device instead of the piezoelectric element 245.

As illustrated in FIG. 11, an adhesive 180 for filling the gap between the edge of the opening portion 155 in the fixing plate 150 and the edge of the compliance portion 230, and the edge of the nozzle plate 210. As the adhesive 180, an epoxy-based adhesive, a silicone-based adhesive, or the like can be used. Since the adhesive 180 is provided, it is possible to suppress an occurrence of a situation in which the ink enters into the gap. In addition, it is possible to improve the wiping property by the wiping operation by coupling the surface of the nozzle plate 210 on the +Z direction side to the first surface 151 of the fixing plate 150 without a step difference between the surface of the nozzle plate 210 on the +Z direction side to the first surface 151 of the fixing plate 150.

Figure 12:
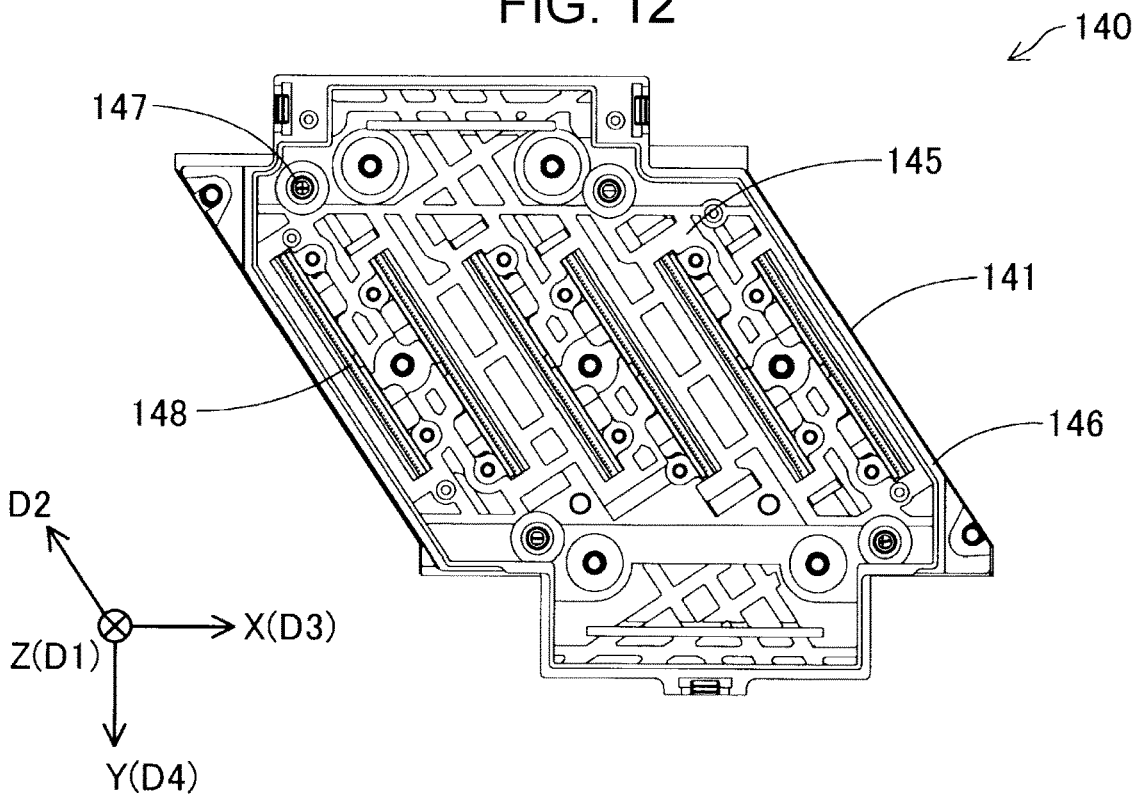
FIG. 12 is a plan view illustrating a configuration of a holder in the first embodiment.

FIG. 12 is a plan view illustrating the configuration of the holder 140. As illustrated in FIG. 12, the first holder member 141 includes an upper surface portion 145, an outer peripheral wall 146, and the above-described upper flowpath pipe 147. The upper surface portion 145 is provided along a plane parallel to the X direction and the Y direction. The outer peripheral wall 146 protrudes in the −Z direction from the outer peripheral edge of the upper surface portion 145. The outer peripheral wall 146 is provided in an annular shape on the outer peripheral edge of the upper surface portion 145. The upper flowpath pipe 147 is disposed inside the outer peripheral wall 146. The upper flowpath pipe 147 protrudes from the upper surface portion 145 in the −Z direction. The upper flowpath pipe 147 is formed in a tubular shape, and has an ink flow path therein. A slit hole 148 through which the flexible wiring substrate 246 of each head chip 200 is inserted is provided in the upper surface portion 145. The outer peripheral wall 146 of the holder 140 may be referred to as a "second outer peripheral wall". The flow path provided in the holder 140 and the flow path provided in the upper flowpath pipe 147 may be referred to as a "second flowpath portion". The upper flowpath pipe 147 may be referred to as a "second flowpath pipe".

Figure 13:
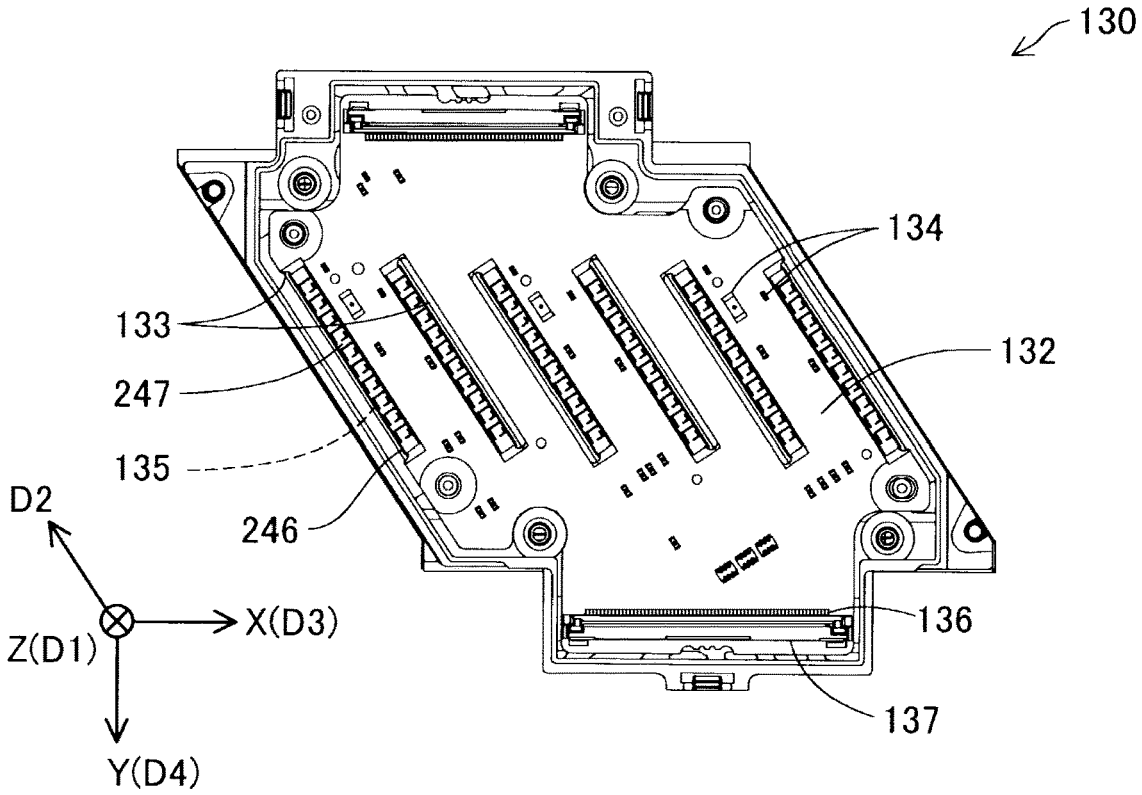
FIG. 13 is a plan view illustrating a configuration of a circuit substrate in the first embodiment.

FIG. 13 is a plan view illustrating the configuration of the circuit substrate 130. FIG. 13 illustrates the circuit substrate 130 fixed to the holder 140, and illustrates a portion of the holder 140 together with the circuit substrate 130. As described above, the circuit substrate 130 has the first surface 131 being the surface on the +Z direction side and the second surface 132 being the surface on the opposite side of the first surface 131. FIG. 13 illustrates the second surface 132. The first surface 131 is in contact with the upper surface portion 145 of the first holder member 141 illustrated in FIG. 12. That is, the first surface 131 is the surface of the circuit substrate 130, which is mounted on the holder 140.

Six opening portions 133 provided in the second direction D2 are provided in the circuit substrate 130. The opening portions 133 are arranged in the X direction. Among the six opening portions 133, two opening portions disposed at both ends in the X direction are provided as notches at the ends of the circuit substrate 130. Four opening portions obtained by excluding two opening portions disposed at both the ends in the X direction among the six opening portions 133 are provided as slit holes. The flexible wiring substrate 246 of the head chip 200 is inserted through each of the opening portions 133.

A plurality of circuit elements 134, six first coupling portions 135 electrically coupled to the coupling terminal portions 247 of the flexible wiring substrates 246, two connectors 137 into which a signal cable KB is inserted, and two second coupling portions 136 electrically and respectively coupled to the connectors 137 are provided on the second surface 132 of the circuit substrate 130. The first coupling portion 135 is configured as a set including a plurality of coupling terminals arranged along the opening portion 133 through which the flexible wiring substrate 246 is inserted. The second coupling portion 136 is configured as a set including a plurality of coupling terminals arranged along the connector 137. The signal cable KB electrically couples the controller 15 and the circuit substrate 130 to each other. In the present embodiment, the signal cable KB is a flexible flat cable. The signal cable KB is not limited to the flexible flat cable, and may be any other type of signal cable such as a flat cable. In the present embodiment, for example, the plurality of circuit elements 134 are discrete components such as resistors, capacitors, transistors, and coils, and are electronic components that protrude by 0.4 mm or more from the second surface 132 of the circuit substrate 130.

The first coupling portions 135 are arranged adjacent to the opening portions 133, respectively, and extend in the second direction D2. The first coupling portions 135 are arranged in the X direction. Each of the coupling terminal portions 247 extends in the second direction D2 in a state of being coupled to the first coupling portion 135.

One of the two connectors 137 is disposed on the +Y direction side with respect to each first coupling portion 135. The other of the two connectors 137 is disposed on the −Y direction side with respect to each first coupling portion 135. The second coupling portions 136 are provided along the connectors 137, respectively. The arrangement of the connectors 137 is not limited to the above-described arrangement. For example, one of the two connectors 137 may be disposed on the +X direction side with respect to the first coupling portions 135, and the other of the two connectors 137 may be disposed on the −X direction side with respect to the first coupling portions 135.

Figure 14:
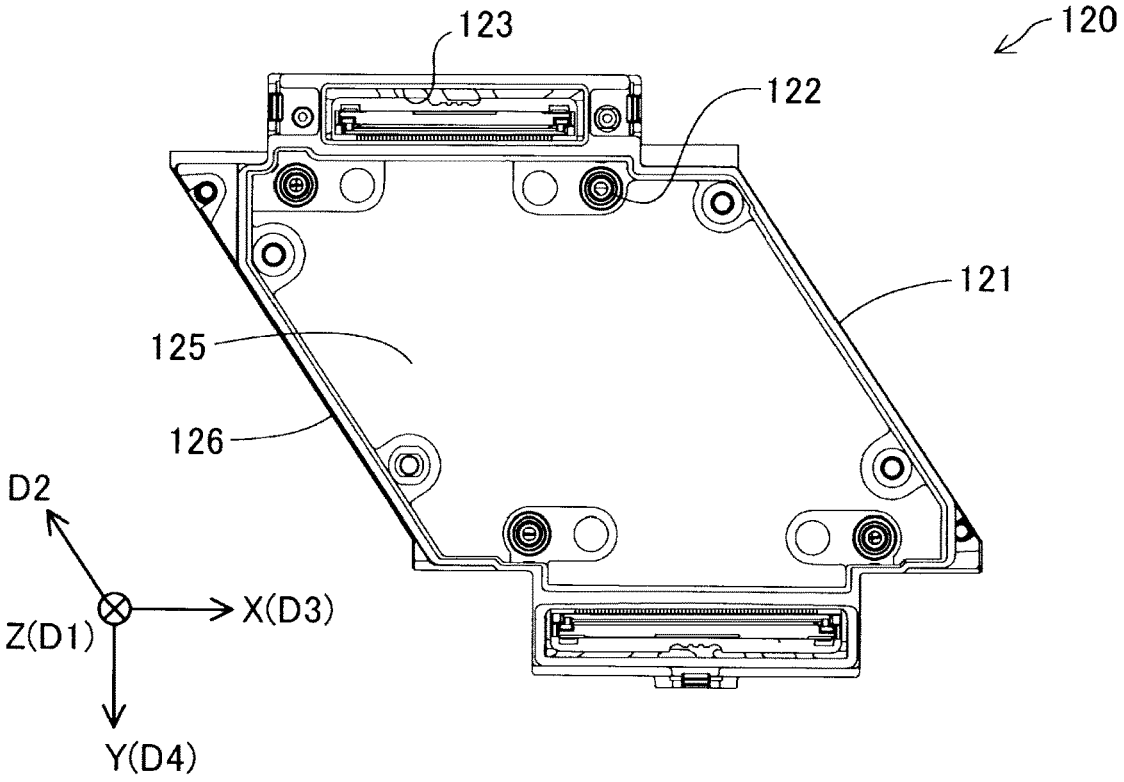
FIG. 14 is a plan view illustrating a configuration of a cover member in the first embodiment.
Figure 15:
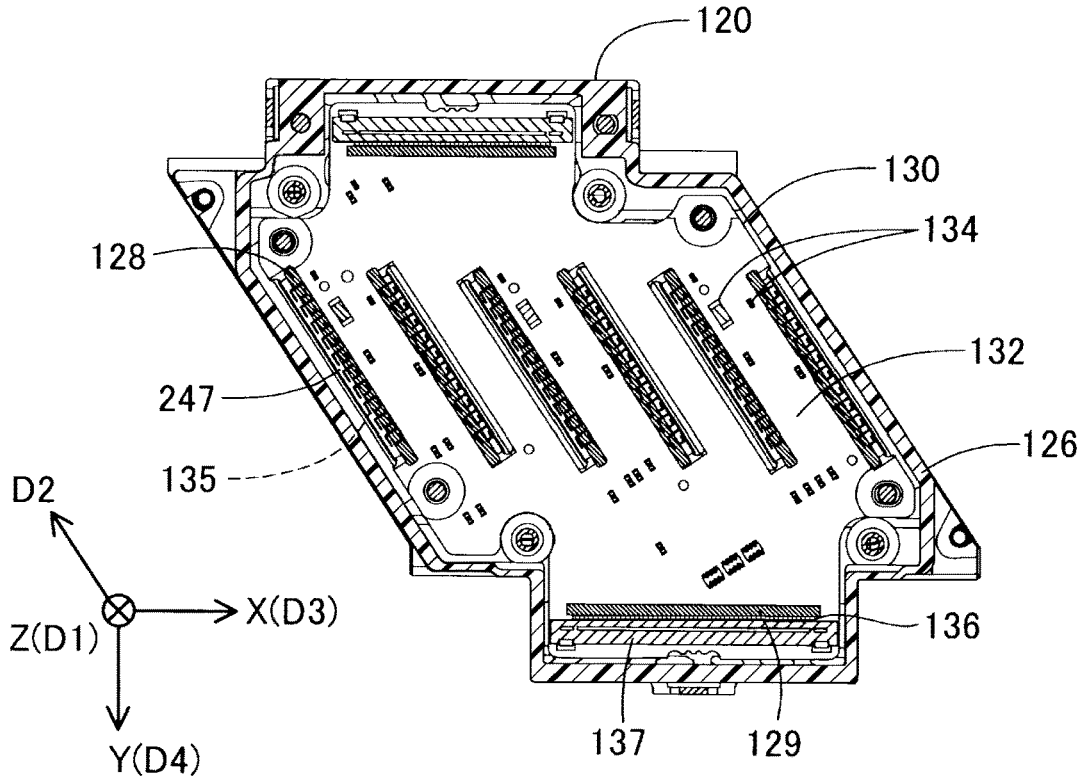
FIG. 15 is a cross-sectional view taken along line XV-XV in FIG. 7.
Figure 16:
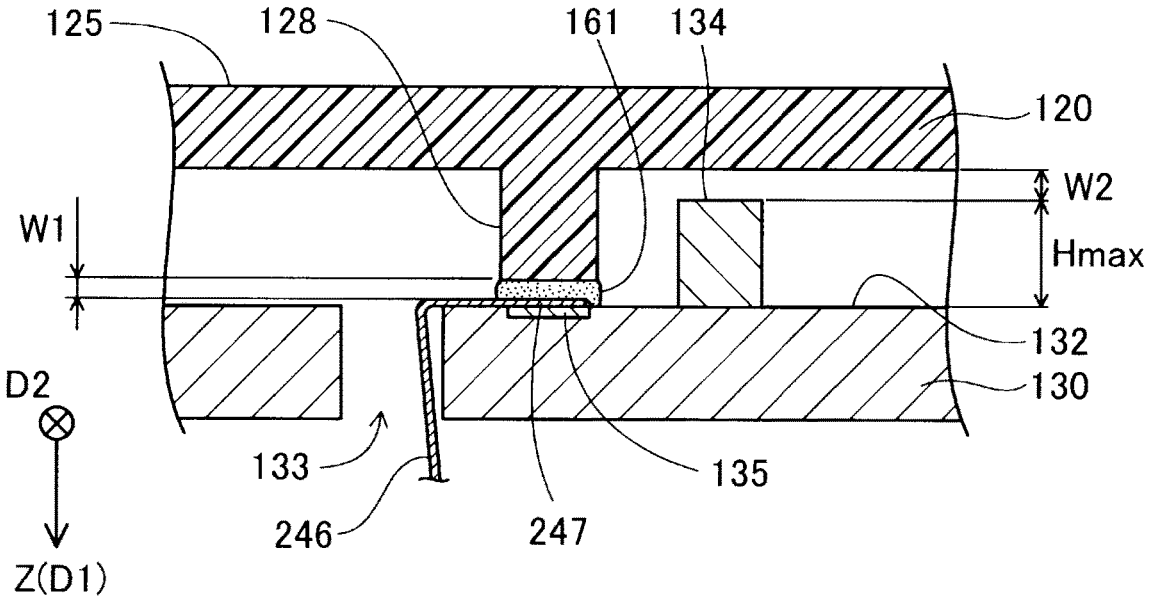
FIG. 16 is a partially enlarged view of a portion XVI in FIG. 9.
Figure 17:
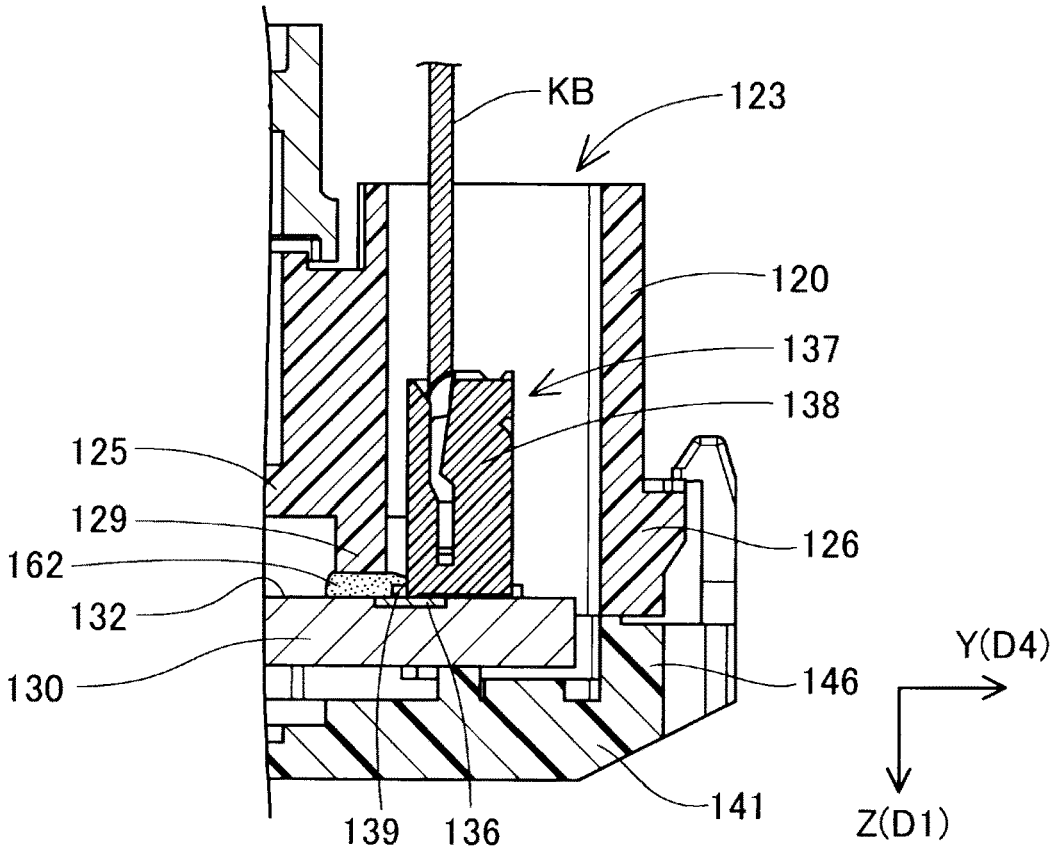
FIG. 17 is a partially enlarged view of a portion XVII in FIG. 10.

FIG. 14 is a plan view illustrating the configuration of the cover member 120. FIG. 15 is a cross-sectional view taken along the line XV-XV in FIG. 7. FIG. 16 is a partially enlarged view of a portion XVI in FIG. 9. FIG. 17 is a partially enlarged view of a portion XVII in FIG. 10. FIG. 14 illustrates the cover member 120 fixed to the holder 140, and illustrates a portion of the holder 140 together with the cover member 120. FIG. 15 illustrates the cross section of the cover member 120 and the second surface 132 of the circuit substrate 130.

As illustrated in FIGS. 14 and 15, the main body portion 121 of the cover member 120 includes a base 125, an outer peripheral wall 126, six first ribs 128, and two second ribs 129. An opening portion 123 through which the signal cable KB is inserted is provided at the end portions of the main body portion 121 on the +Y direction side and the −Y direction side. The outer peripheral wall 126 of the cover member 120 may be referred to as a "first outer peripheral wall".

As illustrated in FIG. 14, the base 125 is provided along a plane parallel to the X direction and the Y direction. As illustrated in FIG. 15, the outer peripheral wall 126 is formed in an annular shape to surround the outer periphery of the circuit substrate 130 when viewed in the +Z direction. As illustrated in FIG. 9, the outer peripheral wall 126 protrudes from the outer peripheral edge of the base 125 in the +Z direction and the −Z direction. In the present embodiment, the lower end portion of the outer peripheral wall 126 of the cover member 120 and the upper end portion of the outer peripheral wall 146 of the first holder member 141 are fixed to each other by an epoxy-based adhesive. The adhesive for adhering the lower end portion of the outer peripheral wall 126 of the cover member 120 and the upper end portion of the outer peripheral wall 146 of the first holder member 141 to each other may be referred to as a "second adhesive". The outer peripheral wall 126 of the cover member 120 and the outer peripheral wall 146 of the first holder member 141 may be fixed by, for example, screws instead of the adhesive.

As illustrated in FIG. 9, each of the first ribs 128 protrudes from the base 125 toward the second surface 132 of the circuit substrate 130, in other words, from the base 125 in the +Z direction. As illustrated in FIG. 10, each of the second ribs 129 protrudes from the base 125 toward the second surface 132 of the circuit substrate 130, in other words, from the base 125 in the +Z direction.

As illustrated in FIG. 15, the first ribs 128 are arranged inside the outer peripheral wall 126. The first ribs 128 are provided in the second direction D2. The first ribs 128 are arranged in the X direction. Each of the first ribs 128 is elongated in the second direction D2. The first ribs 128 are disposed at positions respectively overlapping the coupling terminal portions 247 when viewed in the +Z direction. Each of the first ribs 128 is longer than each of the coupling terminal portions 247 in the second direction D2, and overlaps from one end to the other end of each of the coupling terminal portions 247. The first ribs 128 are disposed at positions that do not overlap the plurality of circuit elements 134 when viewed in the +Z direction. Each of the first ribs 128 is preferably longer than each of the coupling terminal portions 247 in the second direction D2, but may be shorter than each of the coupling terminal portions 247. The first ribs 128 are preferably disposed at the positions that do not overlap the circuit elements 134 when viewed in the +Z direction, but may be disposed at positions overlapping the circuit elements 134.

As illustrated in FIG. 16, in a state where the outer peripheral wall 126 of the cover member 120 is fixed to the outer peripheral wall 146 of the first holder member 141, the first ribs 128 are arranged at a first distance W1 from the coupling terminal portions 247, respectively. The first distance W1 is smaller than a distance Hmax to the second surface 132 from the tip of the maximum protruding circuit element which is the circuit element 134 most protruding in the −Z direction from the second surface 132 among the plurality of circuit elements 134. A second distance W2 from the tip of the maximum protruding circuit element to the surface of the cover member 120, which faces the maximum protruding circuit element is greater than the first distance W1. In the present embodiment, the first distance W1 is equal to or smaller than 0.49 mm. The distance Hmax from the tip of the maximum protruding circuit element to the second surface 132 is equal to or greater than 0.90 mm. The second distance W2 is 0.16 to 0.64 mm. In a state where the outer peripheral wall 126 of the cover member 120 is fixed to the outer peripheral wall 146 of the first holder member 141, a portion of each of the first ribs 128 may come into contact with each of the coupling terminal portions 247. The first distance W1 may be smaller than the distance Hmax from the tip of the maximum protruding circuit element to the second surface 132. The second distance W2 may be equal to or smaller than the first distance W1.

An adhesive 161 is disposed between each of the first ribs 128 and each of the coupling terminal portions 247, and thus the first ribs 128 and the coupling terminal portions 247 are coupled to each other by the adhesive 161. The adhesive 161 is preferably an adhesive having an insulating property. The durometer hardness of the adhesive 161 is preferably equal to or greater than 70 degrees in type D of the durometer hardness (JIS K 6253). The durometer hardness of the adhesive 161 is more preferably equal to or greater than 80 degrees in an environment of 25 degrees Celsius. In the present embodiment, the adhesive 161 is an epoxy-based adhesive. The adhesive 161 contains an epoxy resin as a main agent and contains an aliphatic amine, a polyamide, a polythiol, or the like as a curing agent. The adhesive 161 may be referred to as a "first adhesive". The adhesive 161 preferably has an insulating property, but may not have an insulating property. The durometer hardness of the adhesive 161 is preferably equal to or greater than 70 degrees in type D of the durometer hardness, but may be smaller than 70 degrees in type D of the durometer hardness. The adhesive 161 may be an adhesive other than the epoxy-based adhesive.

As illustrated in FIG. 15, the second ribs 129 are arranged inside the outer peripheral wall 126. One of the two second ribs 129 is disposed on the +Y direction side with respect to the first ribs 128, and the other of the two second ribs 129 is disposed on the −Y direction side with respect to the first ribs 128. The second ribs 129 are provided in the X direction. Each of the second ribs 129 is elongated in the X direction.

As illustrated in FIG. 17, in a state where the outer peripheral wall 126 of the cover member 120 is fixed to the outer peripheral wall 146 of the first holder member 141, the second ribs 129 are disposed at a distance from the second surface 132 of the circuit substrate 130. In a state where the outer peripheral wall 126 of the cover member 120 is fixed to the outer peripheral wall 146 of the first holder member 141, a portion of each of the second ribs 129 may come into contact with the second surface 132.

The connector 137 includes a housing portion 138 and a substrate coupling portion 139. The terminal of the signal cable KB is inserted into the housing portion 138. The substrate coupling portion 139 is electrically coupled to the second coupling portion 136. The substrate coupling portion 139 is disposed between the housing portion 138 and the second rib 129 in the Y direction. The substrate coupling portion 139 may overlap the second rib 129 when viewed in the +Z direction.

An adhesive 162 is disposed between the second rib 129 and the second surface 132. The adhesive 162 covers at least a portion of the substrate coupling portion 139. In the present embodiment, the adhesive 162 covers the entirety of the substrate coupling portion 139. In the present embodiment, the adhesive 162 is an epoxy-based adhesive which is the same as the adhesive 161 disposed between the first rib 128 and the coupling terminal portion 247. The adhesive 162 may be referred to as a "third adhesive". The adhesive 162 may be an adhesive different from the adhesive 161 disposed between the first rib 128 and the coupling terminal portion 247.

Figure 18:
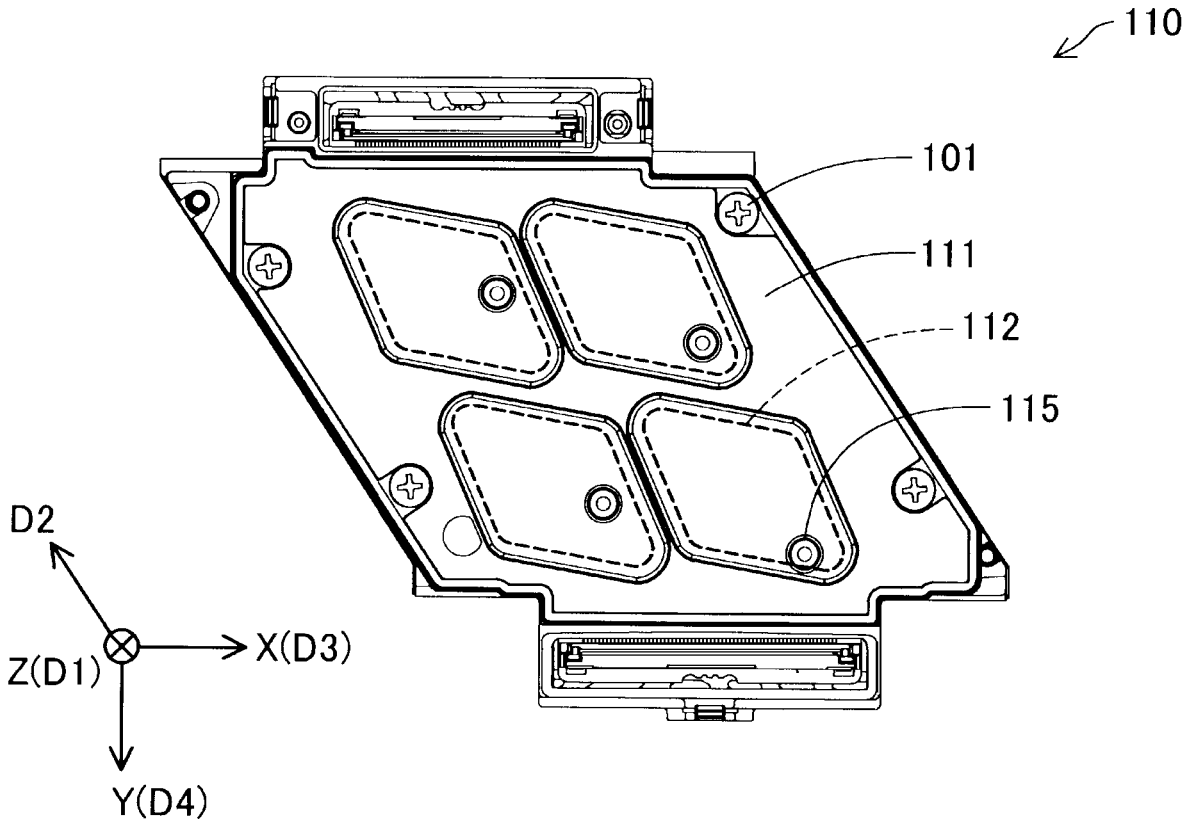
FIG. 18 is a top view illustrating a configuration of a filter unit in the first embodiment.

FIG. 18 is a top view illustrating the configuration of the filter unit 110. FIG. 18 illustrates the screws 101 and the cover member 120 together with the filter unit 110. In the present embodiment, the filter unit 110 and the cover member 120 are fastened by the screws 101 at positions overlapping the circuit substrate 130 when viewed in the +Z direction. The filter unit 110 and the cover member 120 may be fastened by the screws 101 at positions that do not overlap the circuit substrate 130 when viewed in the +Z direction.

Figure 19:
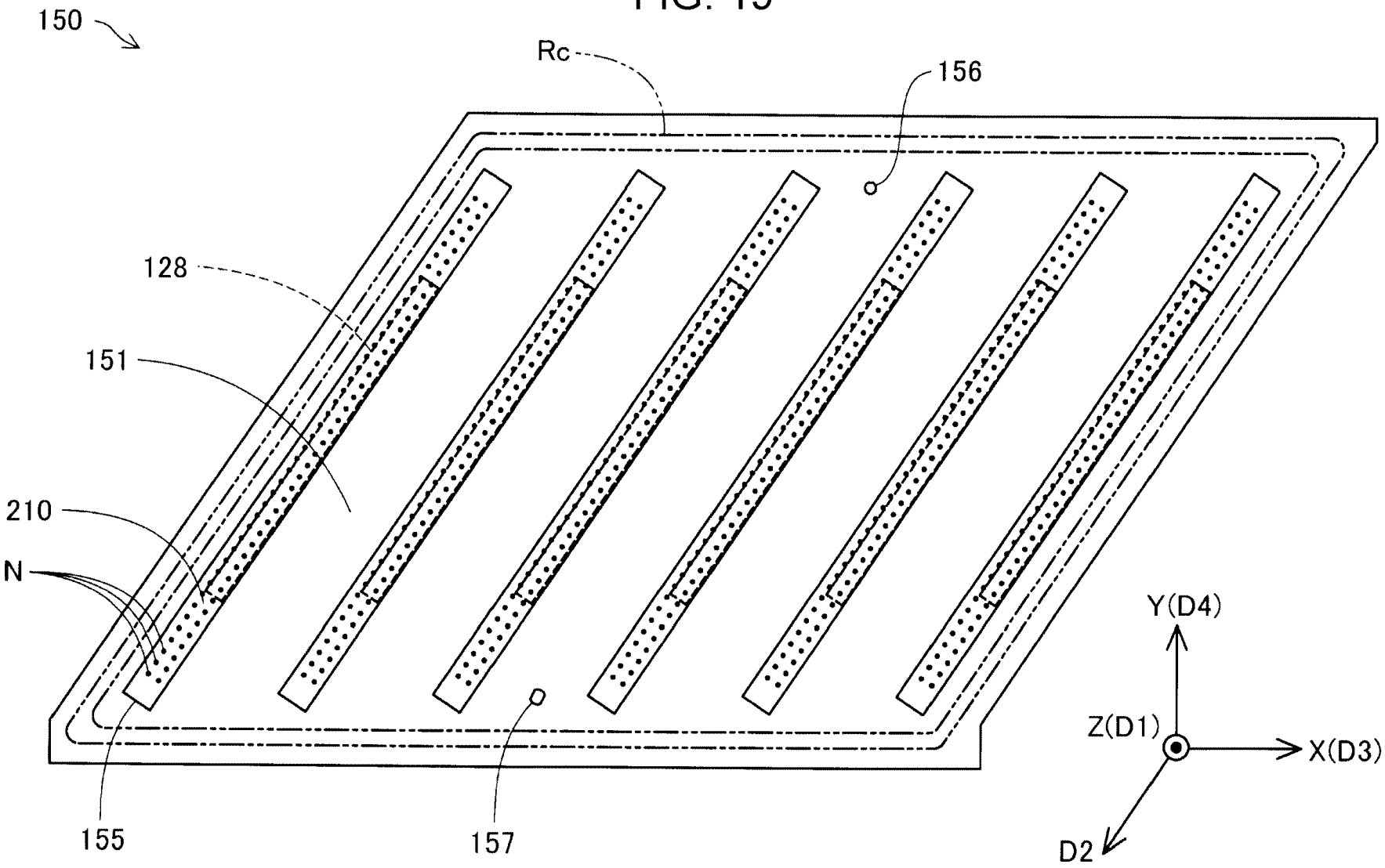
FIG. 19 is a bottom view illustrating an contacting region provided on a fixing plate in the first embodiment.

FIG. 19 is a bottom view illustrating an contacting region Rc provided on the fixing plate 150. The contacting region Rc on which the rib 56 of the cap 53 contacts in capping is provided on the surface of the fixing plate 150 on the +Z direction side. In the present embodiment, the contacting region Rc is provided to surround the six opening portions 155. The first ribs 128 are arranged inside the contacting region Rc.

According to the liquid ejecting apparatus 10 in the present embodiment described above, the adhesive 161 is disposed between each of the first ribs 128 and the coupling terminal portion 247 of each of the flexible wiring substrates 246. Thus, it is possible to suppress an occurrence of a situation in which moisture in the atmosphere that has entered into a space which is provided between the cover member 120 and the first holder member 141 and is for accommodating the circuit substrate 130 adheres to each of the coupling terminal portions 247. Therefore, it is possible to suppress an occurrence of an electrical problem in each of the coupling terminal portions 247. Further, with the six first ribs 128 provided in the cover member 120, it is possible to improve the rigidity of the liquid ejecting head 100. Further, the first ribs 128 and the coupling terminal portions 247 are adhered to each other by the adhesive 161. Thus, for example, when an external force is applied to the liquid ejecting head 100 in the Z direction in capping, it is possible to reduce the stress acting on the outer peripheral wall 126 of the cover member 120 and the outer peripheral wall 146 of the first holder member 141 in comparison to a case where the first ribs 128 and the coupling terminal portions 247 are not adhered to each other. Accordingly, it is possible to effectively suppress the deformation of the liquid ejecting head 100. Further, it is possible to reduce the amount of the adhesive 161 in comparison to a form in which the first ribs 128 are not provided, and a space between the base 125 and the coupling terminal portions 247 is filled with the adhesive 161. Further, it is possible to use the first rib 128 as a mark of the position at which the adhesive 161 is applied, and thus it is possible to facilitate the work of applying the adhesive 161.

In the present embodiment, the outer peripheral wall 126 of the cover member 120 and the outer peripheral wall 146 of the first holder member 141 are adhered to each other by the adhesive. Thus, it is possible to suppress entering of moisture into the space provided between the cover member 120 and the first holder member 141. Further, in a state where the outer peripheral wall 126 of the cover member 120 and the outer peripheral wall 146 of the first holder member 141 are fixed to each other, the first ribs 128 are arranged at a distance from the coupling terminal portions 247, respectively. Therefore, it is possible to suppress formation of a gap between the outer peripheral wall 126 of the cover member 120 and the outer peripheral wall 146 of the first holder member 141, by respectively bringing the first ribs 128 into contact with the coupling terminal portions 247 when the outer peripheral wall 126 of the cover member 120 and the outer peripheral wall 146 of the first holder member 141 are fixed to each other.

In the present embodiment, the first ribs 128 are longer than the coupling terminal portions 247 in the second direction D2. Therefore, it is possible to cover the coupling terminal portions 247 with the adhesive 161 applied to the tips of the first ribs 128 in the second direction D2. Further, since the first ribs 128 are longer than the coupling terminal portions 247, it is possible to easily secure the rigidity of the cover member 120.

In the present embodiment, with the second ribs 129 provided in the cover member 120, it is possible to improve the rigidity of the liquid ejecting head 100. Further, since the second ribs 129 extend in the X direction intersecting the second direction D2 in which the first ribs 128 extend, it is possible to improve the rigidity of the liquid ejecting head 100 in the X direction and the second direction D2. In particular, in the present embodiment, the second ribs 129 are disposed between the coupling terminal portions 247 and the connector 137 when viewed in the +Z direction, and the adhesive 162 is disposed between the second ribs 129 and the second surface 132 of the circuit substrate 130. Therefore, it is possible to suppress an occurrence of a situation in which the moisture entering from the opening portion 123 through which the signal cable KB is inserted moves to the coupling terminal portions 247.

In the present embodiment, in a state where the outer peripheral wall 126 of the cover member 120 and the outer peripheral wall 146 of the holder 140 are fixed to each other, the second ribs 129 are disposed at a distance from the second surface 132 of the circuit substrate 130. Therefore, it is possible to suppress formation of a gap between the outer peripheral wall 126 of the cover member 120 and the outer peripheral wall 146 of the first holder member 141, by bringing the second ribs 129 into contact with the second surface 132 when the outer peripheral wall 126 of the cover member 120 and the outer peripheral wall 146 of the first holder member 141 are fixed to each other.

In the present embodiment, at least the portion of the substrate coupling portion 139 is covered by the adhesive 162 disposed between the second ribs 129 and the second surface 132. Therefore, it is possible to suppress an occurrence of an electrical problem in the substrate coupling portion 139 due to moisture adhering to the substrate coupling portion 139.

In the present embodiment, the cover member 120 includes the main body portion 121 including the plurality of first ribs 128. The main body portion 121 is made of a thermoplastic resin excluding an elastomer or a thermosetting resin. Therefore, in comparison to a case where the first rib 128 is configured by a flexible member, it is possible to suppress deformation of the liquid ejecting head 100 that occurs when a force is applied to the liquid ejecting head 100 in the +Z direction or the −Z direction, by the first rib 128 having rigidity.

In the present embodiment, the cover member 120 includes the main body portion 121 formed of a thermoplastic resin excluding an elastomer or a thermosetting resin, and the elastic seal portion 122 formed of an elastomer. Therefore, it is possible to secure the sealing property between the lower flowpath pipe 116 of the filter unit 110 and the upper flowpath pipe 147 of the holder 140 by the elastic seal portion 122 while securing the rigidity of the cover member 120 by the main body portion 121. In particular, in the present embodiment, the cover member 120 is configured in a manner that the main body portion 121 and the elastic seal portion 122 are integrated. Thus, it is possible to reduce the number of components of the liquid ejecting head 100.

In the present embodiment, each of the liquid ejecting heads 100 includes the filter unit 110. Therefore, it is possible to collect the foreign substances and the like mixed in the ink, by the filter 112. Thus, it is possible to suppress mixing of the foreign substances and the like in the ink to be supplied to each of the head chips 200.

In the present embodiment, the filter unit 110 and the cover member 120 are fastened by the screws 101. Therefore, by providing the first ribs 128 on the cover member 120, it is possible to suppress deformation of the cover member 120 by a fastening force when the filter unit 110 is fastened to the cover member 120 by the screws 101. In particular, in the present embodiment, the filter unit 110 and the cover member 120 are fastened by the screws 101 at positions overlapping the circuit substrate 130 when viewed in the +Z direction. Therefore, the filter unit 110 is fastened to the cover member 120 at a position close to each of the first ribs 128, and thus it is possible to easily disperse the fastening force to the first ribs 128.

In the present embodiment, the first ribs 128 do not overlap the circuit elements 134, respectively, when viewed in the +Z direction. Therefore, it is possible to suppress damaging of the circuit element 134 due to contact of the first rib 128 with the circuit element 134.

In the present embodiment, the first distance W1 between the first ribs 128 and the coupling terminal portions 247 is smaller than the distance Hmax from the tip of the maximum protruding circuit element to the second surface 132. Therefore, it is possible to reduce the first distance W1, and thus it is possible to reduce the amount of the adhesive 161 disposed between the first ribs 128 and the coupling terminal portions 247.

In the present embodiment, the second distance W2 from the tip of the maximum protruding circuit element to the surface of the cover member 120, which faces the maximum protruding circuit element is greater than the first distance W1. Therefore, even though the liquid ejecting head 100 deforms so that the adhesive 161 is crushed and the first ribs 128 becomes close to the coupling terminal portions 247, it is possible to suppress the contact of the maximum protruding circuit element with the cover member 120. Therefore, it is possible to suppress damaging of the maximum protruding circuit element due to the contact with the cover member 120.

In the present embodiment, the adhesive 161 is an adhesive having an insulating property. Therefore, it is possible to secure the insulating property of the coupling terminal portion 247. Thus, it is possible to suppress an occurrence of an electrical problem in the coupling terminal portion 247.

In addition, in the present embodiment, the adhesive 161 is an epoxy-based adhesive. Therefore, it is possible to suppress crushing of the adhesive. In particular, in the present embodiment, the durometer hardness of the adhesive 161 is equal to or greater than 70 degrees in type D of the durometer hardness. Thus, it is possible to reliably suppress crushing of the adhesive 161.

In the present embodiment, capping of sealing the ejecting surface is performed in a manner that the cap 53 relatively moves to the ejecting surface in the Z direction and contacts on the ejecting surface. However, since the first ribs 128 are provided on the cover member 120, it is possible to improve the rigidity of the liquid ejecting head 100, and to suppress deformation of the liquid ejecting head 100 when the cap 53 contacts on the ejecting surface.

B. Other Embodiments

Figure 20:
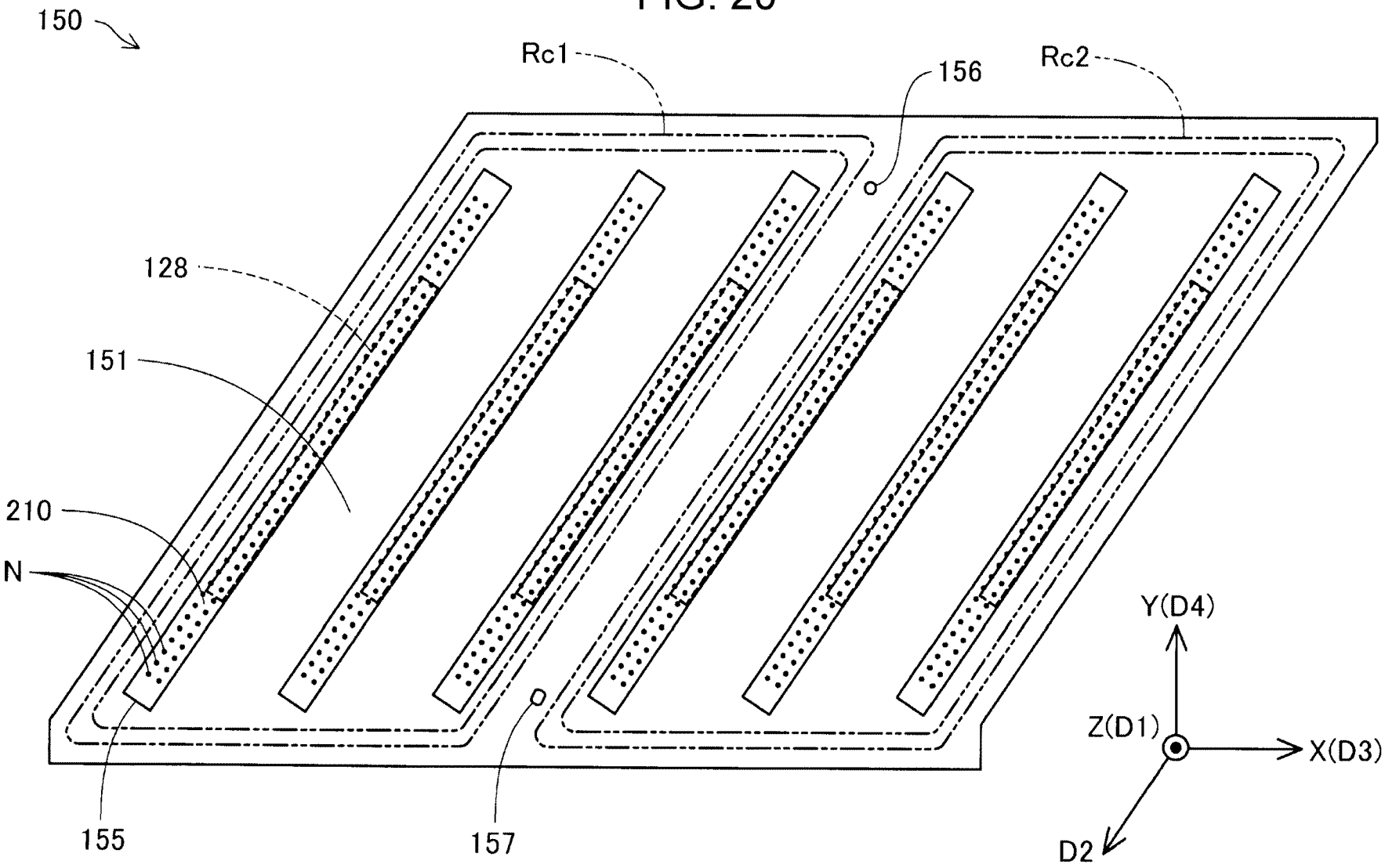
FIG. 20 is a bottom view illustrating an contacting region provided on a fixing plate according to another embodiment.

B1. FIG. 20 is a diagram illustrating the contacting region in another embodiment. In the liquid ejecting apparatus 10 in the above-described embodiment, one cap 53 is provided for one liquid ejecting head 100, and one contacting region Rc is provided for one fixing plate 150. On the other hand, a plurality of caps 53 may be provided for one liquid ejecting head 100, and a plurality of contacting regions may be provided for one fixing plate 150. For example, as illustrated in FIG. 20, the fixing plate 150 may have an contacting region Rc1 and an contacting region Rc2. The contacting region Rc1 is provided to surround three opening portions 155 disposed on the −X direction side among the six opening portions 155. The contacting region Rc2 is provided to surround three opening portions 155 disposed on the +X direction side among the six opening portions 155. The contacting regions Rc1 and Rc2 may be provided to surround at least one of a plurality of projection images obtained by vertically projecting the first ribs 128 onto the surface in which the contacting regions Rc1 and Rc2 are provided. That is, a region Ri surrounded by a first virtual line LN1, a second virtual line LN2, a long side of the projection image of the first rib disposed on the outermost side on the −X direction side among the six first ribs, on the −X direction side, and a long side of the projection image of the first rib disposed on the outermost side on the +X direction side among the six first ribs, on the +X direction side may have a portion overlapping the contacting regions Rc1 and Rc2. The first virtual line LN1 connects end portions of projection images of the first ribs 128 on the +Y direction side. The second virtual line LN2 connects end portions of the projection images of the first ribs 128 on the −Y direction side. In this case, a force in the −Z direction is likely to act on the liquid ejecting head 100 in capping, by providing the plurality of contacting regions Rc1 and Rc2. However, with the first ribs 128, it is possible to disperse the force acting in capping, and thus it is possible to suppress the deformation of the liquid ejecting head 100.

B2. In the liquid ejecting apparatus 10 in the above-described embodiment, the two second ribs 129 are provided on the cover member 120 in the liquid ejecting head 100. On the other hand, the number of the second ribs 129 provided on the cover member 120 may be one. The second rib 129 may not be provided on the cover member 120.

B3. In the liquid ejecting apparatus 10 in the above-described embodiment, at least a portion of the substrate coupling portion 139 of the connector 137 in the liquid ejecting head 100 is covered with the adhesive 162. On the other hand, the substrate coupling portion 139 may not be covered with the adhesive 162.

B4. In the liquid ejecting apparatus 10 in the above-described embodiment, the head chip 200 of the liquid ejecting head 100, the coupling terminal portion 247 of the flexible wiring substrate 246, the first coupling portion 135 of the circuit substrate 130, and the first rib 128 of the cover member 120 extend in the second direction D2. On the other hand, the head chip 200 of the liquid ejecting head 100, the coupling terminal portion 247 of the flexible wiring substrate 246, the first coupling portion 135 of the circuit substrate 130, and the first rib 128 of the cover member 120 may extend in the Y direction.

B5. In the liquid ejecting apparatus 10 in the above-described embodiment, the filter unit 110 may not be provided in the liquid ejecting head 100.

B6. The liquid ejecting apparatus 10 in the above-described embodiment includes the capping mechanism 50. On the other hand, the liquid ejecting apparatus 10 may not include the capping mechanism 50.

B7. The liquid ejecting apparatus 10 in the above-described embodiment includes the suction mechanism 60. On the other hand, the liquid ejecting apparatus 10 may not include the suction mechanism 60.

B8. The liquid ejecting apparatus 10 in the above-described embodiment includes the wiping mechanism 70. On the other hand, the liquid ejecting apparatus 10 may not include the wiping mechanism 70.

B9. The liquid ejecting apparatus 10 in the above-described embodiment includes the transport mechanism 40 that transports a medium M. On the other hand, in the liquid ejecting apparatus 10, the transport mechanism 40 may move the head unit 30 in the Y direction to relatively move a medium M and the head unit 30 without transporting the medium M.

B10. The liquid ejecting apparatus 10 in the above-described embodiment is configured as a line printer. On the other hand, the liquid ejecting apparatus 10 may be configured as a serial printer. In this case, the liquid ejecting apparatus 10 may include a carriage that holds the liquid ejecting head 100 and reciprocates in the X direction perpendicular to the +Y direction being the transport direction of the medium M.

Figure 21:
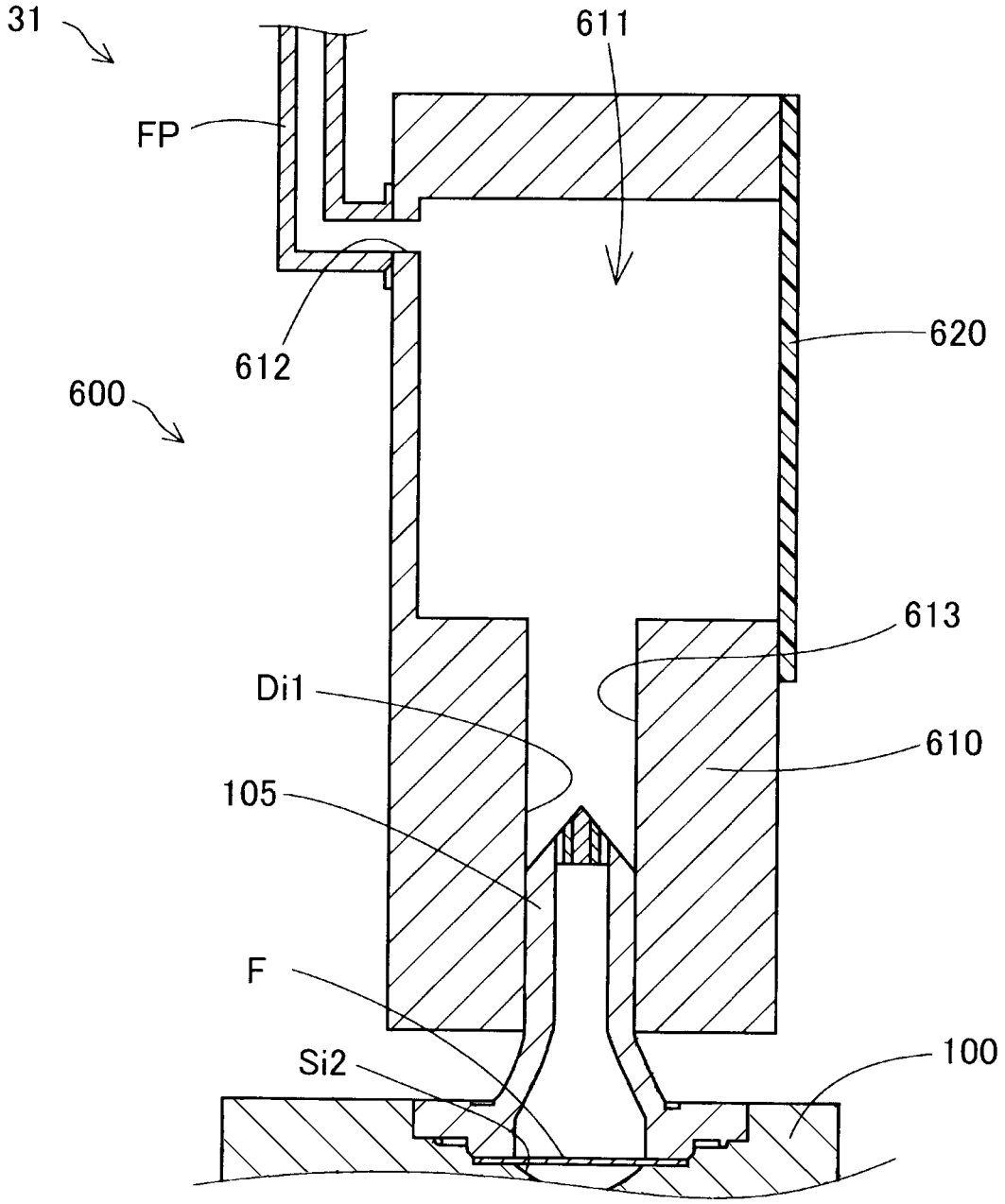
FIG. 21 is a first cross-sectional view illustrating a configuration of a first liquid outflow port in the other embodiment.

B11. FIG. 21 is a first cross-sectional view illustrating the configuration of the first liquid outflow port Di1 of a head unit 30 in another embodiment. In the liquid ejecting apparatus 10 in the above-described embodiment, a pressure adjusting portion 600 illustrated in FIG. 21 may be provided in the distribution flowpath member 31 of the head unit 30 instead of the pressure adjusting valve 500 illustrated in FIG. 5. The pressure adjusting portion 600 includes a housing 610 and a flexible film member 620. A damper chamber 611, an inflow path 612, and an outflow path 613 are provided in the housing 610. The damper chamber 611 is formed by sealing an opening portion of a recess provided in the housing 610 with the film member 620. The damper chamber 611 communicates with the individual flow path FP through the inflow path 612, and communicates with the first liquid outflow port Di1 through the outflow path 613. The supply needle 105 provided in the liquid ejecting head 100 is inserted through the first liquid outflow port Di1. The inner diameter of the first liquid outflow port Di1 is substantially equal to the outer diameter of the supply needle 105. The ink flowing into the damper chamber 611 from the inflow path 612 is supplied to the liquid ejecting head 100 through the outflow path 613. Since a portion of the inner wall surface of the damper chamber 611 is configured by the flexible film member 620, it is possible to suppress the pressure fluctuation of the ink supplied to the liquid ejecting head 100 by bending the film member 620.

Figure 22:
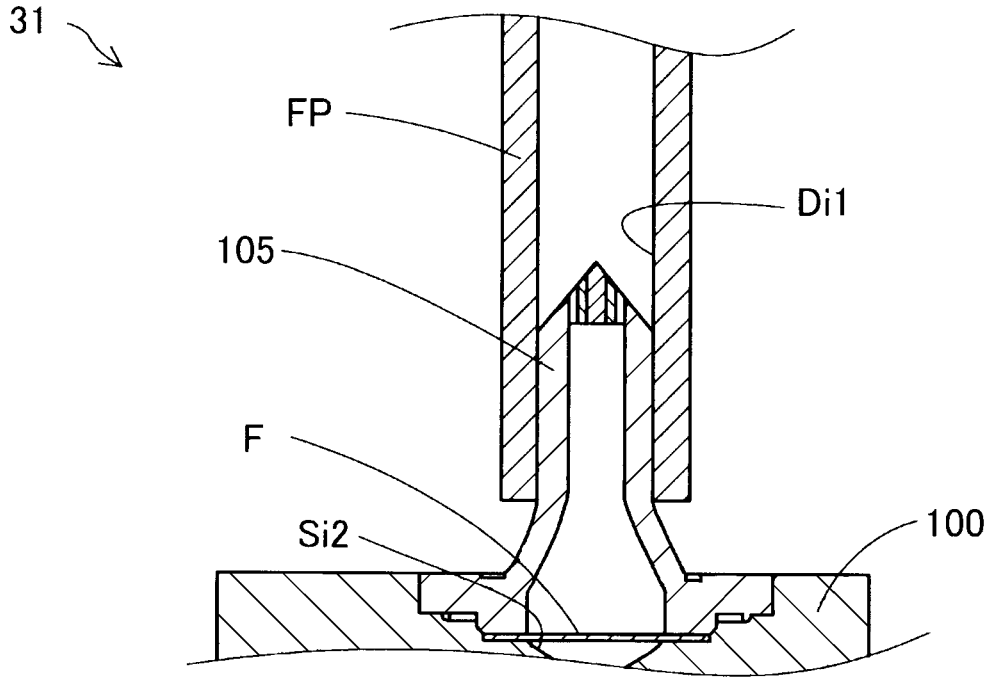
FIG. 22 is a second cross-sectional view illustrating the configuration of the first liquid outflow port in the other embodiment.

B12. FIG. 22 is a second cross-sectional view illustrating the configuration of the first liquid outflow port Di1 of the head unit 30 in another embodiment. In the liquid ejecting apparatus 10 in the above-described embodiment, the pressure adjusting valve 500 illustrated in FIG. 5 may not be provided. In this case, as illustrated in FIG. 22, the supply needle 105 provided in the liquid ejecting head 100 is inserted through the first liquid outflow port Di1 provided at the end portion of the individual flow path FP. The inner diameter of the first liquid outflow port Di1 is substantially equal to the outer diameter of the supply needle 105.

B13. In the above-described embodiment, the X direction and the Y direction are directions parallel to the horizontal plane, and the +Z direction is the direction of gravity. However, the present disclosure is not limited thereto. For example, the +Z direction being the direction in which the liquid is ejected from the nozzle N may be a direction different from the direction of gravity, and the X direction and the Y direction may be directions that are not parallel to the horizontal plane.

C. Other Embodiments

The present disclosure is not limited to the above-described embodiment, and can be realized in various forms without departing from the spirit thereof. For example, the present disclosure can also be realized in the following forms. The technical features in embodiments described below correspond to the technical features in the above embodiment can be appropriately replaced and combined in order to solve some or all of the problems of the present disclosure, or to achieve some or all of the effects of the present disclosure. Further, the technical features can be appropriately deleted so long as the technical features are not described as being essential in the present specification.

1. According to a first aspect of the present disclosure, a liquid ejecting head is provided. The liquid ejecting head includes a plurality of head chips that eject a liquid in a first direction, a holder to which the plurality of head chips are fixed, a circuit substrate disposed in an opposite direction to the first direction with respect to the holder, and a cover member disposed in the opposite direction to the first direction with respect to the circuit substrate. Each of the plurality of head chips includes a flexible wiring substrate. The flexible wiring substrate includes a coupling terminal portion coupled to the circuit substrate. The circuit substrate has a first surface mounted on the holder and a second surface that opposes the first surface and is coupled to the coupling terminal portion. The cover member includes a plurality of first ribs protruding toward the second surface of the circuit substrate. The plurality of first ribs are disposed at positions respectively overlapping the coupling terminal portions of the plurality of head chips when viewed in the first direction. A first adhesive is disposed between the plurality of first ribs and the coupling terminal portions of the plurality of head chips.

According to the liquid ejecting head in this aspect, since the first adhesive is disposed between the first rib of the cover member and the coupling terminal portion of the flexible substrate coupled to the circuit substrate disposed between the holder and the cover member, it is possible to suppress adhering of moisture in the atmosphere that has entered between the holder and the cover member, to the coupling terminal portion. Therefore, it is possible to suppress an occurrence of an electrical problem in the coupling terminal portion. Further, it is possible to improve the rigidity of the liquid ejecting head by providing the first rib in the cover member.

2. In the liquid ejecting head in the above aspect, the cover member may have a first outer peripheral wall that has an annular shape and surrounds the circuit substrate when viewed in the first direction. The holder may have a second outer peripheral wall that has an annular shape and surrounds the circuit substrate when viewed in the first direction. The cover member and the holder may be fixed in a manner that the first outer peripheral wall and the second outer peripheral wall are adhered to each other with a second adhesive. Each of the plurality of first ribs may be disposed at a distance from the coupling terminal portion in a state where the first outer peripheral wall and the second outer peripheral wall are fixed to each other.

According to the liquid ejecting head in this aspect, since the first outer peripheral wall and the second outer peripheral wall are adhered to each other by the second adhesive, it is possible to suppress entering of moisture into a space between the holder and the cover member. Further, since the first rib is disposed at a distance from the coupling terminal portion in a state where the first outer peripheral wall and the second outer peripheral wall are fixed to each other, it is possible to suppress formation of a gap between the first outer peripheral wall and the second outer peripheral wall due to the contact of the first rib with the coupling terminal portion when the first outer peripheral wall and the second outer peripheral wall are fixed to each other.

3. In the liquid ejecting head in the above aspect, each of the coupling terminal portions and the first ribs may extend in a second direction perpendicular to the first direction. The first rib may be longer than the coupling terminal portion in the second direction.

According to the liquid ejecting head in this aspect, since the first rib is longer than the coupling terminal portion, it is possible to cover the entirety of the coupling terminal portion by the first adhesive disposed between the first rib and the coupling terminal portion. Further, since the first rib is longer than the coupling terminal portion, it is possible to easily secure the strength of the first rib.

4. In the liquid ejecting head in the above aspect, each of the coupling terminal portions and the first ribs may extend in a second direction perpendicular to the first direction. The plurality of head chips may be arranged in a third direction that is perpendicular to the first direction and intersects the second direction. The coupling terminal portions of the plurality of head chips may be arranged in the third direction. The plurality of first ribs may be arranged in the third direction.

According to the liquid ejecting head in this aspect, it is possible to improve the rigidity of the liquid ejecting head in both the second direction and the third direction.

5. In the liquid ejecting head in the above aspect, a connector coupled to a signal cable may be disposed on the second surface of the circuit substrate. The cover member may include an opening portion through which the signal cable is inserted, and a second rib that protrudes toward the second surface of the circuit substrate. The second rib may be disposed between the coupling terminal portions of the plurality of head chips and the connector when viewed in the first direction. A third adhesive may be disposed between the second rib and the second surface of the circuit substrate.

According to the liquid ejecting head in this aspect, it is possible to further improve the rigidity of the liquid ejecting head by providing the second rib in the cover member. Further, since the second rib is provided between the connector coupled to the signal cable and the coupling terminal portion, and the third adhesive is disposed between the second rib and the circuit substrate, it is possible to suppress an occurrence of a situation in which moisture that has entered from the opening portion through which the signal cable is inserted moves to the space in which the coupling terminal portion is disposed.

6. In the liquid ejecting head in the above aspect, the connector may be disposed in a fourth direction perpendicular to both the first direction and the third direction, with respect to the coupling terminal portions of the plurality of head chips. The second rib may be long in the third direction.

According to the liquid ejecting head in this aspect, since the second rib extends in a direction in which the plurality of first ribs are arranged, it is possible to effectively improve the rigidity of the liquid ejecting head.

7. In the liquid ejecting head in the above aspect, the cover member may have a first outer peripheral wall that has an annular shape and surrounds the circuit substrate when viewed in the first direction. The holder may have a second outer peripheral wall that has an annular shape and surrounds the circuit substrate when viewed in the first direction. The cover member and the holder may be fixed in a manner that the first outer peripheral wall and the second outer peripheral wall are adhered to each other with a second adhesive. The second rib may be provided at a distance from the second surface of the circuit substrate in a state where the cover member is fixed to the holder.

According to the liquid ejecting head in this aspect, since the first outer peripheral wall and the second outer peripheral wall are adhered to each other by the second adhesive, it is possible to suppress entering of moisture into a space between the holder and the cover member. Further, since the second rib is disposed at a distance from the second surface of the circuit substrate in a state where the first outer peripheral wall and the second outer peripheral wall are fixed to each other, it is possible to suppress formation of a gap between the first outer peripheral wall and the second outer peripheral wall due to the contact of the second rib with the second surface when the first outer peripheral wall and the second outer peripheral wall are fixed to each other.

8. In the liquid ejecting head in the above aspect, the connector may include a housing portion into which a terminal of the signal cable is inserted, and a substrate coupling portion electrically coupled to the circuit substrate. The substrate coupling portion may be disposed between the housing portion and the second rib when viewed in the first direction. The third adhesive may cover at least a portion of the substrate coupling portion.

According to the liquid ejecting head in this aspect, since at least a portion of the substrate coupling portion of the connector is covered with the third adhesive, it is possible to suppress an occurrence of an electrical problem in the connector due to adhering of moisture to the substrate coupling portion.

9. In the liquid ejecting head in the above aspect, the cover member may include a main body portion that includes the plurality of first ribs. The main body portion may be made of a thermoplastic resin excluding an elastomer or a thermosetting resin.

According to the liquid ejecting head in this aspect, in comparison to a case where the first rib is configured by a flexible member, it is possible to suppress deformation of the liquid ejecting head that occurs when a force is applied to the liquid ejecting head in the first direction or an opposite direction of the first direction, by the first rib having rigidity.

10. In the liquid ejecting head in the above aspect, the liquid ejecting head may further include a flowpath member disposed in the opposite direction to the first direction with respect to the cover member. The flowpath member may include a first flowpath portion, and a first flowpath pipe that constitutes a portion of the first flowpath portion and protrudes toward the holder. The holder may include a second flowpath portion that communicates with the first flowpath portion and supplies the liquid to the plurality of head chips, and a second flowpath pipe that constitutes a portion of the second flowpath portion and protrudes toward the flowpath member. The cover member may include an elastic seal portion into which the first flowpath pipe and the second flowpath pipe are inserted. The main body portion and the elastic seal portion may be integrally provided.

According to the liquid ejecting head in this aspect, it is possible to secure the sealing property between the first flowpath pipe and the second flowpath pipe by the elastic seal member while securing the rigidity of the cover member by the main body portion. Further, since the main body portion and the elastic seal member are integrally provided, it is possible to reduce the number of components of the liquid ejecting head.

11. In the liquid ejecting head in the above aspect, the liquid ejecting head may further include a flowpath member disposed in the opposite direction to the first direction with respect to the cover member. The flowpath member and the cover member may be fastened by screws.

According to the liquid ejecting head in this aspect, since the first rib is provided in the cover member, it is possible to suppress deformation of the cover member by the fastening force when the flowpath member is fastened to the cover member by the screws.

12. In the liquid ejecting head in the above aspect, the flowpath member and the cover member may be fastened by the screws at positions overlapping the circuit substrate when viewed in the first direction.

According to the liquid ejecting head in this aspect, since the flowpath member and the cover member are fastened by the screws at positions overlapping the circuit substrate, which are relatively close to the first rib, it is possible to effectively suppress the deformation of the cover member by the fastening force when the flowpath member is fastened to the cover member by the screws.

13. In the liquid ejecting head in the above aspect, the flowpath member may include a filter through which the liquid passes.

14. In the liquid ejecting head in the above aspect, a plurality of circuit elements may be provided on the second surface of the circuit substrate. The plurality of first ribs may not overlap the plurality of circuit elements when viewed in the first direction.

According to the liquid ejecting head in this aspect, it is possible to suppress damaging of the circuit element due to the contact of the first rib with the circuit element.

15. In the liquid ejecting head in the above aspect, the first rib may be disposed at a first distance from the coupling terminal portion in a state where the cover member is fixed to the holder. The first distance may be smaller than a distance to the second surface from a tip of a maximum protruding circuit element that protrudes most from the second surface of the circuit substrate among the plurality of circuit elements.

According to the liquid ejecting head in this aspect, since it is possible to reduce the first distance between the first rib and the coupling terminal portion, it is possible to reduce the amount of the first adhesive disposed between the first rib and the coupling terminal portion.

16. In the liquid ejecting head in the above aspect, a second distance from the tip of the maximum protruding circuit element to a surface of the cover member, that faces the maximum protruding circuit element may be greater than the first distance.

According to the liquid ejecting head in this aspect, when the first adhesive is crushed due to the deformation of the liquid ejecting head and the distance between the first rib and the coupling terminal portion is reduced, it is possible to suppress the contact of the maximum protruding circuit element with the cover member. Therefore, it is possible to suppress damaging of the maximum protruding circuit element due to the contact with the cover member.

17. In the liquid ejecting head in the above aspect, the first adhesive may be an adhesive having an insulating property.

According to the liquid ejecting head in this aspect, since it is possible to secure the insulating property of the coupling terminal portion, it is possible to suppress an occurrence of an electrical problem in the coupling terminal portion.

18. In the liquid ejecting head in the above aspect, the first adhesive may be an epoxy-based adhesive.

According to the liquid ejecting head in this aspect, it is possible to suppress crushing of the first adhesive.

19. In the liquid ejecting head in the above aspect, the durometer hardness of the first adhesive may be equal to or greater than 70 degrees in type D of the durometer hardness.

According to the liquid ejecting head in this aspect, it is possible to suppress crushing of the first adhesive.

20. According to a second aspect of the present disclosure, a liquid ejecting apparatus is provided. The liquid ejecting apparatus includes the above-described liquid ejecting head in the first aspect, and a cap. The liquid ejecting head includes an ejecting surface on which the liquid is ejected. The cap seals the ejecting surface by relatively moving to the ejecting surface in the opposite direction to the first direction and contacting on the ejecting surface.

According to the liquid ejecting apparatus in this aspect, since the first adhesive is disposed between the first rib of the cover member and the coupling terminal portion of the flexible substrate coupled to the circuit substrate disposed between the holder and the cover member, it is possible to suppress adhering of moisture in the atmosphere that has entered between the holder and the cover member, to the coupling terminal portion. Therefore, it is possible to suppress an occurrence of an electrical problem in the coupling terminal portion. Further, since it is possible to improve the rigidity of the liquid ejecting head by providing the first rib in the cover member, it is possible to suppress the deformation of the liquid ejecting head when the cap contacts on the ejecting surface.

21. In the liquid ejecting apparatus in the above aspect, the liquid ejecting apparatus may include the liquid ejecting head in the above-described first aspect, and a plurality of caps. The liquid ejecting head may include an ejecting surface on which the liquid is ejected. The plurality of caps may seal the ejecting surface by relatively moving to the ejecting surface in the opposite direction to the first direction and contacting on the ejecting surface. A plurality of contacting regions in which the plurality of caps contact may be provided in the ejecting surface. Each of the plurality of contacting regions may be provided to surround at least one of a plurality of projection images obtained by vertically projecting each of the plurality of first ribs onto the ejecting surface.

According to the liquid ejecting apparatus in this aspect, it is possible to suppress adhering of the moisture in the atmosphere that has entered between the holder and the cover member, to the coupling terminal portion. Further, it is possible to effectively suppress the deformation of the liquid ejecting head when each cap contacts on the ejecting surface.

22. In the liquid ejecting apparatus in the above aspect, the liquid ejecting apparatus may include the liquid ejecting head in the above-described first aspect, and the signal cable coupled to the connector.

According to the liquid ejecting apparatus in this aspect, in the form of including the signal cable, it is possible to suppress adhering of the moisture in the atmosphere that has entered between the holder and the cover member, to the coupling terminal portion, and to improve the rigidity of the liquid ejecting head.

23. In the liquid ejecting apparatus in the above aspect, the liquid ejecting apparatus may include the liquid ejecting head in the above-described first aspect, and a transport mechanism that transports a medium.

According to the liquid ejecting apparatus in this aspect, in the form of including the transport mechanism, it is possible to suppress adhering of the moisture in the atmosphere that has entered between the holder and the cover member, to the coupling terminal portion, and to improve the rigidity of the liquid ejecting head.

The present disclosure can also be realized in various forms other than the liquid ejecting head. For example, the present disclosure can be realized in the form of a liquid ejecting apparatus, a head unit, or the like.

What is claimed is:

1. A liquid ejecting head comprising:

head chips configured to eject a liquid in a first direction;

a holder to which the head chips are fixed;

a circuit substrate disposed in an opposite direction to the first direction with respect to the holder; and a cover member disposed in the opposite direction to the first direction with respect to the circuit substrate, wherein each of the head chips includes a flexible wiring substrate, each of the flexible wiring substrates includes a coupling terminal portion coupled to the circuit substrate, the circuit substrate has a first surface that is mounted on the holder and that faces the first direction, and a second surface that is opposite from the first surface and that is coupled to the coupling terminal portions, the cover member includes first ribs protruding in the first direction toward the second surface of the circuit substrate, the first ribs respectively overlap the coupling terminal portions in the first direction, and a first adhesive is disposed between the first ribs and the coupling terminal portions in the first direction.

2. The liquid ejecting head according to claim 1, wherein the cover member includes a first outer peripheral wall that has an annular shape and surrounds the circuit substrate when viewed in the first direction, the holder includes a second outer peripheral wall that has an annular shape and surrounds the circuit substrate when viewed in the first direction, the cover member and the holder are fixed in a manner that the first outer peripheral wall and the second outer peripheral wall are adhered to each other with a second adhesive, and each of the first ribs is disposed at a distance from the coupling terminal portion in a state where the first outer peripheral wall and the second outer peripheral wall are fixed to each other.

3. The liquid ejecting head according to claim 1, wherein each of the coupling terminal portions and the first ribs extends in a second direction perpendicular to the first direction, and the first rib is longer than the coupling terminal portion in the second direction.

4. The liquid ejecting head according to claim 1, wherein each of the coupling terminal portions and the first ribs extends in a second direction perpendicular to the first direction, the head chips are arranged in a third direction that is perpendicular to the first direction and intersects the second direction, the coupling terminal portions are arranged in the third direction, and the first ribs are arranged in the third direction.

5. The liquid ejecting head according to claim 4, wherein a connector coupled to a signal cable is disposed on the second surface of the circuit substrate, the cover member includes an opening portion through which the signal cable is inserted, and a second rib that protrudes toward the second surface of the circuit substrate, the second rib is disposed between the coupling terminal portions and the connector when viewed in the first direction, and a third adhesive is disposed between the second rib and the second surface of the circuit substrate.

6. The liquid ejecting head according to claim 5, wherein the connector is disposed in a fourth direction perpendicular to both the first direction and the third direction, with respect to the coupling terminal portions, and the second rib is long in the third direction.

7. The liquid ejecting head according to claim 5, wherein the cover member includes a first outer peripheral wall that has an annular shape and surrounds the circuit substrate when viewed in the first direction, the holder includes a second outer peripheral wall that has an annular shape and surrounds the circuit substrate when viewed in the first direction, the cover member and the holder are fixed in a manner that the first outer peripheral wall and the second outer peripheral wall are adhered to each other with a second adhesive, and the second rib is provided at a distance from the second surface of the circuit substrate in a state where the cover member is fixed to the holder.

8. The liquid ejecting head according to claim 5, wherein the connector includes a housing portion into which a terminal of the signal cable is inserted, and a substrate coupling portion electrically coupled to the circuit substrate, the substrate coupling portion is disposed between the housing portion and the second rib when viewed in the first direction, and the third adhesive covers at least a portion of the substrate coupling portion.

9. The liquid ejecting head according to claim 1, wherein the cover member includes a main body portion that includes the first ribs, and the main body portion is made of a thermoplastic resin excluding an elastomer or a thermosetting resin.

10. The liquid ejecting head according to claim 9, further comprising:

a flowpath member disposed in the opposite direction to the first direction with respect to the cover member, wherein the flowpath member includes a first flowpath portion, and a first flowpath pipe that constitutes a portion of the first flowpath portion and protrudes toward the holder, the holder includes a second flowpath portion that communicates with the first flowpath portion and supplies the liquid to the head chips, and a second flowpath pipe that constitutes a portion of the second flowpath portion and protrudes toward the flowpath member, the cover member includes an elastic seal portion into which the first flowpath pipe and the second flowpath pipe are inserted, and the main body portion and the elastic seal portion are integrally provided.

11. The liquid ejecting head according to claim 1, further comprising:

a flowpath member disposed in the opposite direction to the first direction with respect to the cover member, wherein the flowpath member and the cover member are fastened by screws.

12. The liquid ejecting head according to claim 11, wherein the flowpath member and the cover member are fastened by the screws at positions overlapping the circuit substrate when viewed in the first direction.

13. The liquid ejecting head according to claim 1, wherein circuit elements are provided on the second surface of the circuit substrate, and the first ribs do not overlap the circuit elements when viewed in the first direction.

14. The liquid ejecting head according to claim 13, wherein the first rib is disposed at a first distance from the coupling terminal portion to the holder in a state where the cover member is fixed, and the first distance is smaller than a distance from a tip of a maximum protruding circuit element that protrudes most from the second surface among the circuit elements to the second surface.

15. The liquid ejecting head according to claim 14, wherein a second distance from the tip of the maximum protruding circuit element to a surface of the cover member, the surface facing the maximum protruding circuit element, is greater than the first distance.

16. The liquid ejecting head according to claim 1, wherein the first adhesive is an epoxy-based adhesive and an adhesive having an insulating property.

17. The liquid ejecting head according to claim 1, wherein durometer hardness of the first adhesive is equal to or greater than 70 degrees in type D of the durometer hardness.

18. A liquid ejecting apparatus comprising:
the liquid ejecting head according to claim 1; and
a cap, wherein
the liquid ejecting head includes an ejecting surface on which the liquid is ejected, and
the cap seals the ejecting surface by relatively moving to the ejecting surface in the opposite direction to the first direction and contacting on the ejecting surface.

19. A liquid ejecting apparatus comprising:
the liquid ejecting head according to claim 1; and
caps, wherein
the liquid ejecting head includes an ejecting surface on which the liquid is ejected,
the caps seal the ejecting surface by relatively moving to the ejecting surface in the opposite direction to the first direction and contacting on the ejecting surface,
contacting regions in which the caps contact are provided in the ejecting surface, and
each of the contacting regions is provided to surround at least one of projection images obtained by vertically projecting each of the first ribs onto the ejecting surface.

20. A liquid ejecting apparatus comprising:
the liquid ejecting head according to claim 5; and
the signal cable coupled to the connector.

* * * * *